US006318803B1

(12) United States Patent
Garland

(10) Patent No.: US 6,318,803 B1
(45) Date of Patent: Nov. 20, 2001

(54) CHAIR EXECUTING OSCILLATORY MOTION

(75) Inventor: Thomas A. Garland, Jamestown, RI (US)

(73) Assignee: Motion Technology, LLC, Jamestown, RI (US)

( * ) Notice: Subject to any disclaimer, the term of this patent is extended or adjusted under 35 U.S.C. 154(b) by 0 days.

(21) Appl. No.: 09/173,252

(22) Filed: Oct. 14, 1998

Related U.S. Application Data

(60) Provisional application No. 60/062,341, filed on Oct. 15, 1997.

(51) Int. Cl.[7] ..... A47C 1/02

(52) U.S. Cl. ..... 297/344.11; 248/133; 297/259.2; 297/270.2; 297/281

(58) Field of Search ..... 297/344.11, 281, 297/258.1, 259.1, 260.2, 259.2, 247, 246, 270.1, 270.2, 270.3, 271.1, 272.2, 282, 273, DIG. 7; 5/127, 129; 248/133, 144, 398; 74/106

(56) References Cited

U.S. PATENT DOCUMENTS

| | | | | |
|---|---|---|---|---|
| 1,212,675 | * | 1/1917 | PettyJohn | 297/271.1 X |
| 2,044,862 | * | 6/1936 | Smith | 5/127 X |
| 2,683,481 | | 7/1954 | Lorenz | 155/61 |
| 3,758,156 | | 9/1973 | Zawadzki | 297/260 |
| 4,536,029 | | 8/1985 | Rogers, Jr. | 297/281 |
| 4,544,201 | * | 10/1985 | Rogers, Jr. | 297/259.2 |
| 4,640,546 | | 2/1987 | Aguilar | 297/260 |
| 4,700,920 | | 10/1987 | Horn | 248/370 |
| 4,775,184 | | 10/1988 | Larkin | 297/260 |
| 4,911,499 | | 3/1990 | Meeker | 297/260 |
| 5,280,996 | * | 1/1994 | Trent | 297/270.2 |
| 5,558,397 | | 9/1996 | Chang | 297/281 |
| 5,618,016 | * | 4/1997 | Garland et al. | 248/133 |
| 5,765,913 | | 6/1998 | LaPointe et al. | 297/281 |
| 6,106,062 | * | 8/2000 | Ambrose, Jr. et al. | 297/281 |

FOREIGN PATENT DOCUMENTS

| | | |
|---|---|---|
| 19743902A1 | 4/1998 | (DE) . |
| 2.118.308 | 12/1970 | (FR) . |
| 2171610A | 3/1985 | (GB) . |

* cited by examiner

*Primary Examiner*—Peter M. Cuomo
*Assistant Examiner*—Stephen Vu
(74) *Attorney, Agent, or Firm*—Bromberg & Sunstein LLP

(57) ABSTRACT

An apparatus for imparting substantially oscillatory motion to a subject. The apparatus has a support assembly for supporting the subject and an oscillatory mechanism for defining a path of motion of the support assembly, the path having a region of bilateral symmetry with respect to a reference point. An actuator assembly which may be coupled to the oscillatory mechanism enables the subject to control the oscillatory mechanism, as well as to brake and lock the motion of the mechanism. The apparatus may allow for the subject to recline on an articulated support assembly, in which case the equilibrium center of gravity of the support assembly is maintained substantially at the centerpoint of the path of motion regardless of the relative orientation of the articulated segments of the support assembly.

38 Claims, 14 Drawing Sheets

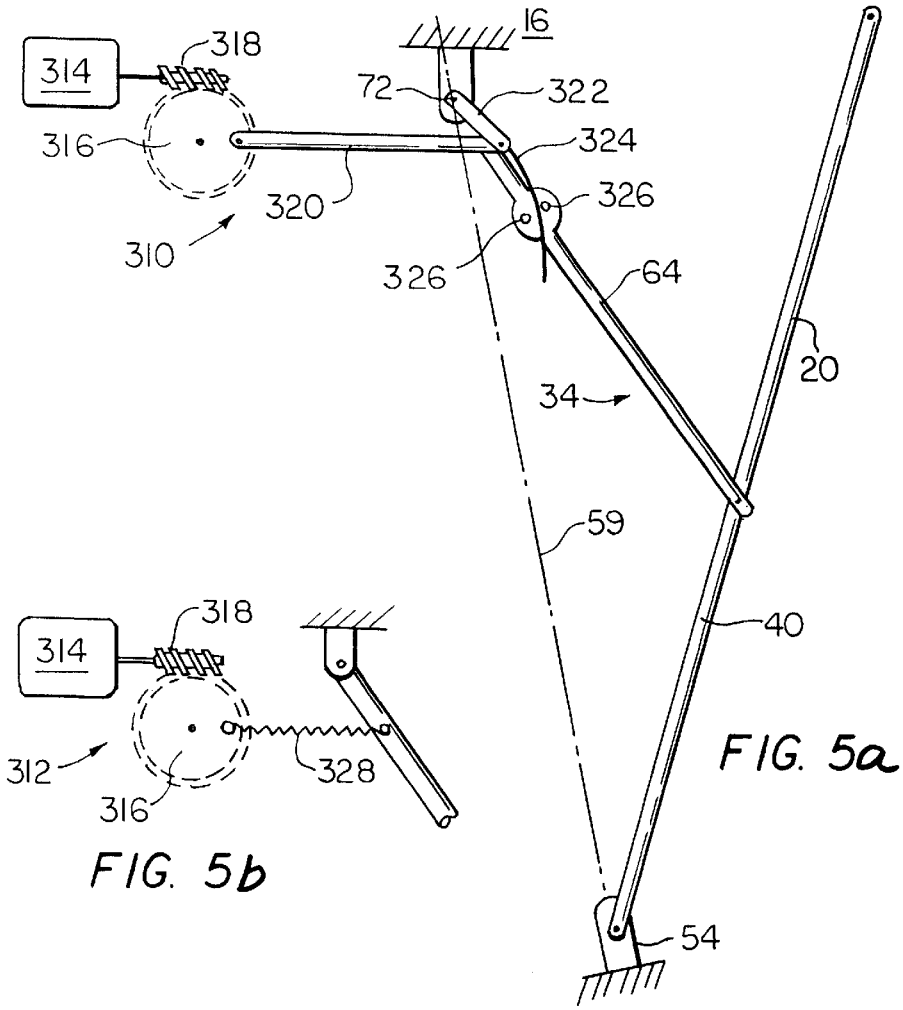
FIG. 5a
FIG. 5b
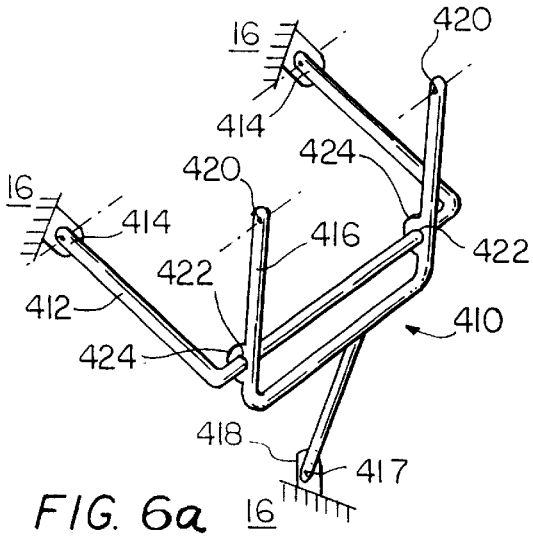
FIG. 6a
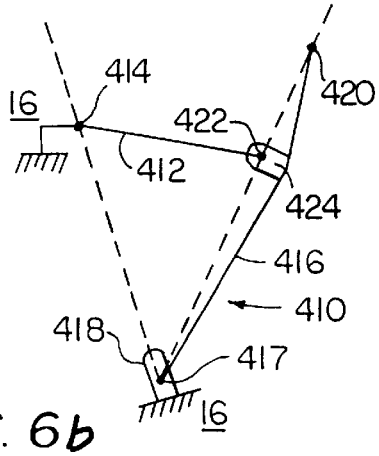
FIG. 6b

CHAIR EXECUTING OSCILLATORY MOTION

The present application claims priority from U.S. provisional application No. 60/062,341 filed Oct. 15, 1997, which application is herein incorporated by reference.

TECHNICAL FIELD

The present invention relates generally to furniture for imparting oscillatory motion to a subject, and more particularly to furniture having an actuator mechanism for control of the oscillatory motion by the subject.

BACKGROUND OF THE INVENTION

Various designs of furniture for supporting one or more persons, typically in either a seated or reclining position, and, additionally, for providing some motion relative to the ground or floor of an assembly that supports the person, are known in the art. Such furniture, as broadly described, includes such common items as rocking chairs and gliders. Additional devices that are fixed in position and both support a person and that provide for motion of the person fall into the category of juvenile products or physical exercise equipment. In some cases, motion of the supporting assembly is relative to a base component of the furniture item, where the base component is supported by the floor or ground. In the present description and in any appended claims, the term "floor" will be used to encompass any surface upon which an item of furniture may rest, and may include, without limitation, the ground.

One means known for providing for motion of a support assembly relative to a base of an item of furniture utilizes linkage assemblies which produce an arc-like path and was previously discussed in U.S. Pat. No. 5,618,016 (the "'016 patent"), which patent is incorporated herein by reference.

Furniture items, such as those surveyed in the foregoing paragraphs, that provide for motion of one or more supported persons, typically require either:

(1) that a force be exerted on the supporting assembly with respect to a surface external to the furniture; or (2) that an occupant displace his center of gravity substantially to cause or sustain oscillatory motion.

Thus, for example, an ordinary rocking chair is driven by action of the feet of the occupant against the floor, or, in some cases, against an ottoman. In order to maintain a continuous motion such as an oscillatory rocking, the occupant's feet must either be kept on the floor or periodically placed there to drive the motion. In a common suspended swing or its variants, the occupant must exert enough force to substantially shift his center of gravity with respect to the equilibrium point of the motion. In either case, braking the motion of the support similarly requires exertion of a force with respect to a stationary surface or substantial motion of the center of gravity of the occupant.

SUMMARY OF THE INVENTION

In accordance with a preferred embodiment of the present invention, there is provided an apparatus for imparting substantially oscillatory motion to a subject. The apparatus has a support assembly for supporting the subject and an oscillatory mechanism that defines a path of motion of the support assembly, where the path has a region bilaterally symmetrical with respect to a reference point. Additionally, the apparatus has an actuator permitting the subject while supported by the support assembly to apply a non-gravitational acceleration to the support assembly.

In accordance with an alternate embodiment of the invention, the actuator may permit the subject while supported by the support assembly to initiate or control motion in such a manner that the center of gravity of the subject may remain fixed relative to the support assembly. Alternatively, the path of motion may have a midpoint, and any vertical component of the path of motion may be substantially symmetric about the midpoint, with the oscillatory mechanism being devoid of a pivot above the subject. The path of motion may have a pair of endpoints and a position set in from the endpoints where the support assembly comes to rest in the absence of non-gravitational external forces.

In accordance with other embodiments of the present invention, the oscillatory mechanism may be devoid of a pivot above the reach of the subject in normal repose on the support assembly, and the support assembly may have an armrest, and the oscillatory mechanism may have at least one pivot, where all pivots are disposed substantially below the superior surface of the armrest.

In accordance with further alternate embodiments of the present invention, the actuator assembly may include a member movable by the subject, the member may be coupled to the oscillatory mechanism, mechanically or otherwise. The member may impart motion to the support assembly, and may, alternatively or additionally, brake the motion of the support assembly. The member may be a handle for actuation by a hand of the subject or a foot pedal for actuation by at least one of a leg and a foot of the subject.

The support assembly, the subject, and a portion of the oscillatory mechanism together comprise a carriage assembly. In accordance with another embodiment of the invention, the support assembly may further include a coupling between at least two articulating segments so as to maintain an equilibrium position of the center of gravity of the carriage assembly substantially at a centerpoint of the path of motion of the center of gravity regardless of the orientation of an articulating segment relative to any other articulating segment of the support assembly.

In accordance with other alternate embodiments of the present invention, the oscillatory mechanism may be a glider mechanism, and the support assembly may be a chair, a couch, or a bed, and may include a plurality mutually articulating segments for permitting the subject to sit and to recline thereupon. The oscillatory mechanism may also be a rocker mechanism, and may have a link assembly that has a first link connected at a first point to a translation mechanism attached to the support assembly, the translation mechanism arranged to allow the first point of the first link to translate along a substantially straight axis, and a second link pivotally connected at a first point to the support assembly and pivotally connected at a second point to the first link, such that a second point of the first link travels on or near an arc of substantially constant finite radius when the first link pivots with respect to the second link.

In accordance with yet further alternate embodiments of the present invention, the apparatus may also have a brake mechanism for arresting the motion of the support assembly and a centering brake assembly for enabling the subject to arrest the motion of the support assembly from a range of positions along the path of motion of the support assembly. The actuator may include a motor and a power control for the motor, the power control being accessible to the subject. The oscillatory mechanism may be substantially contained within a volume beneath the armrest. The oscillatory mechanism has an arrangement for modifying a period of oscillation of the support assembly.

In accordance with another aspect of the present invention, there is provided a recliner. The recliner has a support assembly capable of oscillatory motion, a foot rest extension mechanism such that reclining a back rest portion of the support assembly rearward about the pivot urges the foot rest portion from a first position substantially below the seat portion to a second position in substantial extension of the seat portion, and an oscillatory mechanism that defines a path of motion of the support assembly.

In accordance with yet a further aspect of the present invention, there is provided a method for inducing oscillatory motion of a subject. The method has the steps of:

a. providing an apparatus that has a support, an oscillatory mechanism that defines a path of motion with a region bilaterally symmetrical with respect to a reference point, and an actuator permitting the subject, while supported by the support, to control the oscillatory mechanism; and b. disposing the subject upon the support of the apparatus.

The method, moreover, may provide relaxation to the subject and the period of the oscillation may be timed in advantageous relation to the resting heart rate of the subject.

BRIEF DESCRIPTION OF THE DRAWINGS

The invention will be more readily understood by reference to the following description, taken with the accompanying drawings, in which:

FIGS. 5*a* and 5*b* are side schematic views of mechanisms for driving the linkage assembly of FIGS. 2*a*, 2*b*, and 2*c;*

FIGS. 6*a* and 6*b* are perspective and side schematic views of a linkage assembly in accordance with an alternate embodiment of the present invention

DETAILED DESCRIPTION OF SPECIFIC EMBODIMENTS

Oscillatory motion, especially at a cadence approximating a resting heart rate, may be soothing to a person, and, more particularly, oscillation of a support surface may be advantageously employed in both seating products and beds.

Figure 1A:
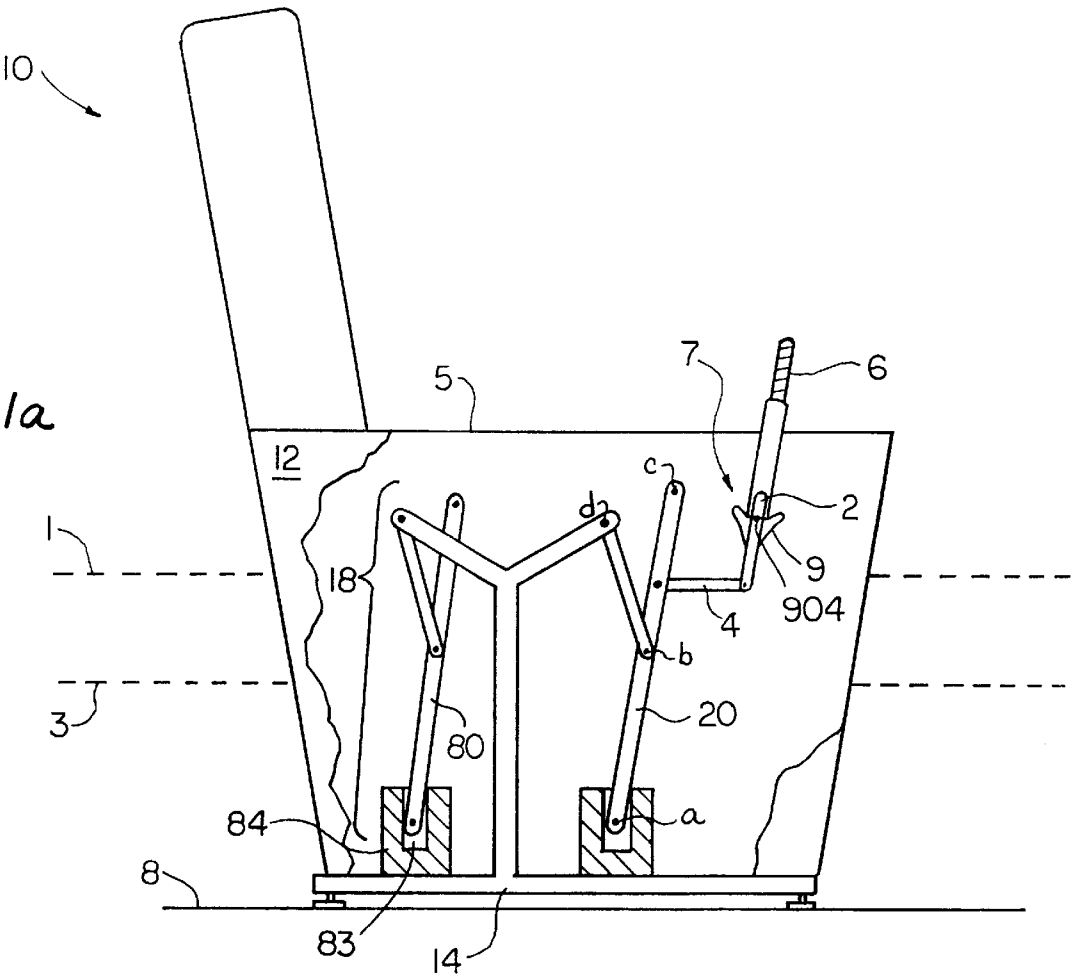
FIG. 1*a* is a side view of an oscillating seat showing a linkage mechanism and a remote handle in accordance with a preferred embodiment of the present invention.

Referring to FIG. 1*a*, an oscillating seat is shown and designated generally by numeral 10. Oscillating seat 10 includes a chair 12 which serves as a support surface. A housing of chair 12 is cut away in this view, so as to expose a linkage assembly 18) serves as a support structure and, attached at the base of frame 14, substantially encloses linkage assembly 18. Linkage assembly 18 connects frame 14 to chair 12 and is described in detail below in connection with FIGS. 2*a*, 2*b*, and 2*c*. Links 20 and 80 of linkage assembly 18 are coupled to chair 12 and slide within slots 83 of slider 84 which is attached to frame 14. As links 20 and 80 translate fore and aft relative to frame 14, so also does chair 12. More generally, the scope of the present invention encompasses an apparatus, which may be a piece of furniture, and is described in terms of oscillating seat 10 which is shown as an example only, and without limitation. Basic components of the piece of furniture which is the subject of preferred embodiments of the present invention include a moving support assembly, of which chair 12 is an example, which supports a human subject (not shown) and which undergoes motion relative to a component of the piece of furniture, referred to as a "base," of which frame 14 is an example. Chair 12 has a seating surface (not shown), having an upper surface generally coinciding with the dashed line designated by numeral 1, and a lower surface generally coinciding with the dashed line designated by numeral 3. Base 14 is supported by floor 8, and may rest on casters or otherwise. The motion executed by the support assembly may have both horizontal and vertical components, with the horizontal component being in the fore-aft direction (as in the motion of a rocker or a glider), or in a lateral direction (as in the motion of a hammock), or in any combination of the two directions. The vertical component of the motion may be zero or substantially zero. Moving portions of the support assembly and the oscillatory mechanism, along with the body of the supported person supported may be referred to collectively as a carriage assembly and may be characterized by a center of gravity.

It should be noted that linkage assembly 18 is shown by way of example, and without limitation, whereas the coupling between the support assembly 12 and base 14 is more generally an oscillatory mechanism of any sort known to persons skilled in the mechanical arts, and may include the motion of wheels in a track or any suspension means or any other coupling mechanism. Linkage assembly 18 may be advantageously disposed in the volume beneath the armrests 5, and, moreover, disposition of linkage assembly 18 substantially in the volume beneath armrests 5 may advantageously provide enhanced motion fore and aft and provide convenient access for attachment of actuators for control by the occupant of the motion of the seat, as further discussed below. The horizontal component of the motion of the support assembly may be characterized as having a midpoint, as described below, and any vertical component of the motion may be constrained to be bilaterally symmetrical over some portion of the travel with respect to a reference point defined along the path of travel.

Also shown in FIG. 1*a* is an actuator 6, which may, by way of example, be a handle, which allows the seated subject to drive mechanism 18, and, through the drive mechanism, support assembly 12, into oscillatory motion. Actuator 6 may also be a foot pedal, as described below, or any other mechanism for allowing the subject to excite or otherwise control the oscillatory motion of the support assembly. Actuator 6 may be coupled to drive mechanism 18 either directly or via a connector 4, and may be advantageously disposed in the space above upper seat surface 1. However actuator 6 need not be coupled to the drive mechanism. For example, actuator 6 may include handles attached to fixed base 14. Actuator 6 is shown in an embodiment in which it pivots about pivot 2, and also provides for braking and locking the support assembly by means of braking assembly 7 as described in detail below with reference to FIGS. 9*a* and 9*b*.

Figure 10A:
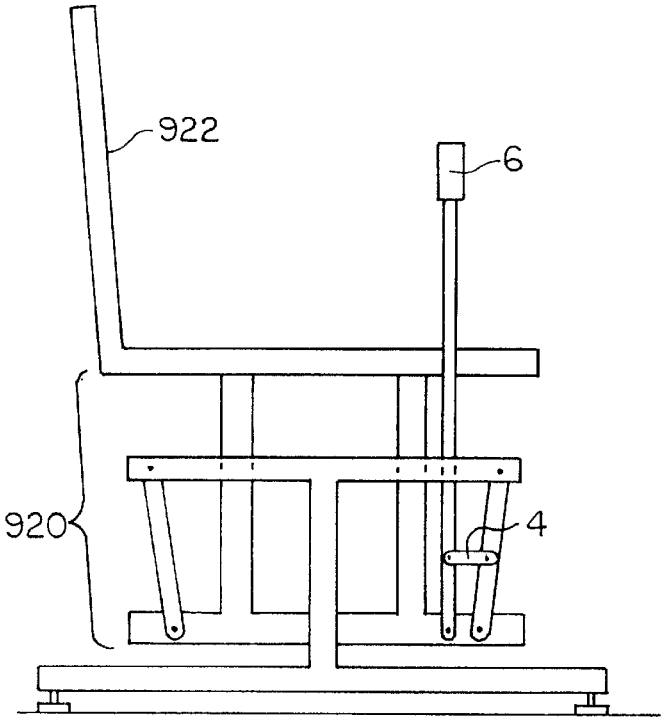
FIG. 10*a* is a schematic view of a glider mechanism controlled by a handle in accordance with an embodiment of the present invention.
Figure 10B:
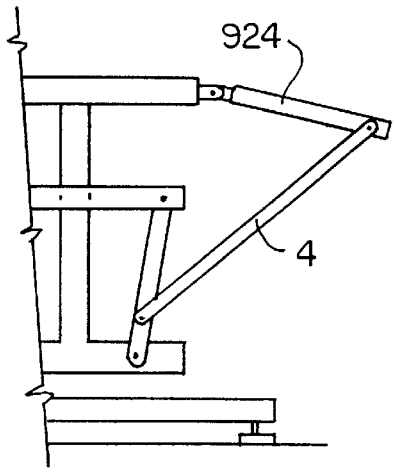
FIG. 10*b* shows a foot or leg pedal for control of a glider mechanism.
Figure 11:
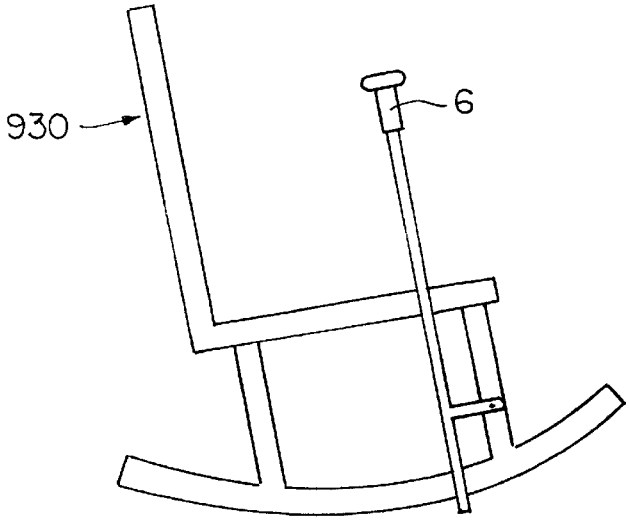
FIG. 11 is a side view of a rocker seat with a handle for actuation by an occupant in accordance with an embodiment of the present invention.

Other embodiments of the invention are shown in FIGS. 10*a*, 10*b*, and 11. In FIG. 10*a*, a glider mechanism 920 is shown for providing oscillatory motion of chair 922. An occupant (not shown) of chair 922 may control the motion of the chair by exerting a force on handle 6, coupled via link 4 to glider mechanism 920. Alternatively, as depicted in FIG. 10*b*, control of glider mechanism 920 may be provided via foot pedal 924 and link 4. Referring to FIG. 11, a further embodiment of the invention is shown whereby actuator 6 is coupled to rocker 930 to permit excitation of the rocker by an occupant. In embodiments, such as those depicted in FIGS. 10*a–b*, electrical, or other arts for coupling the actuator to drive mechanism 18. As evident to a person skilled in the mechanical arts, various remote handles, for operation by hand or foot or otherwise, may be coupled for remote activation by the subject of the oscillatory mechanism.

Figure 1C:
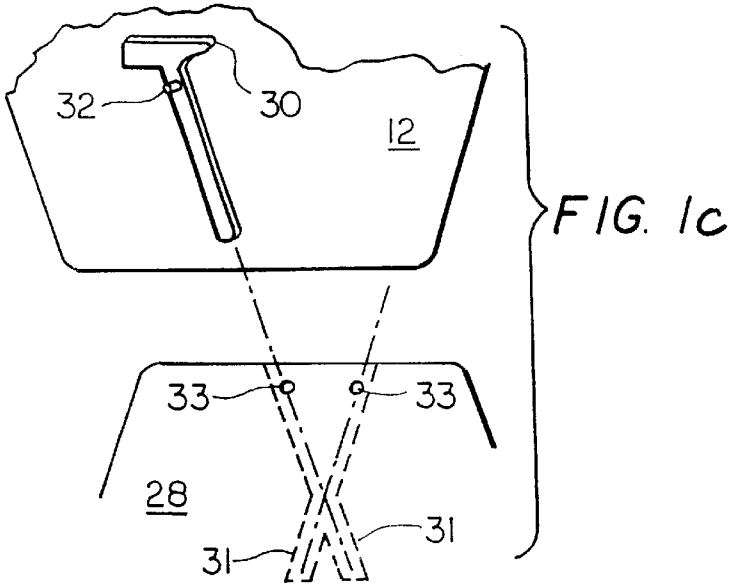
FIG. 1*c* is an exploded detail view of the tilt/latching mechanism of FIG. 1*b;*
Figure 1D:
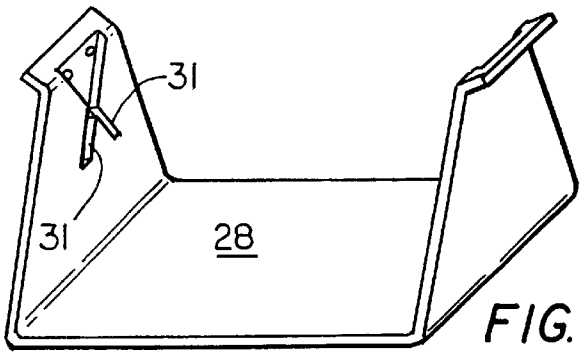
FIG. 1*d* is a perspective view of a portion of the tilt/latching mechanism of FIG. 1*b;*
Figure 1B:
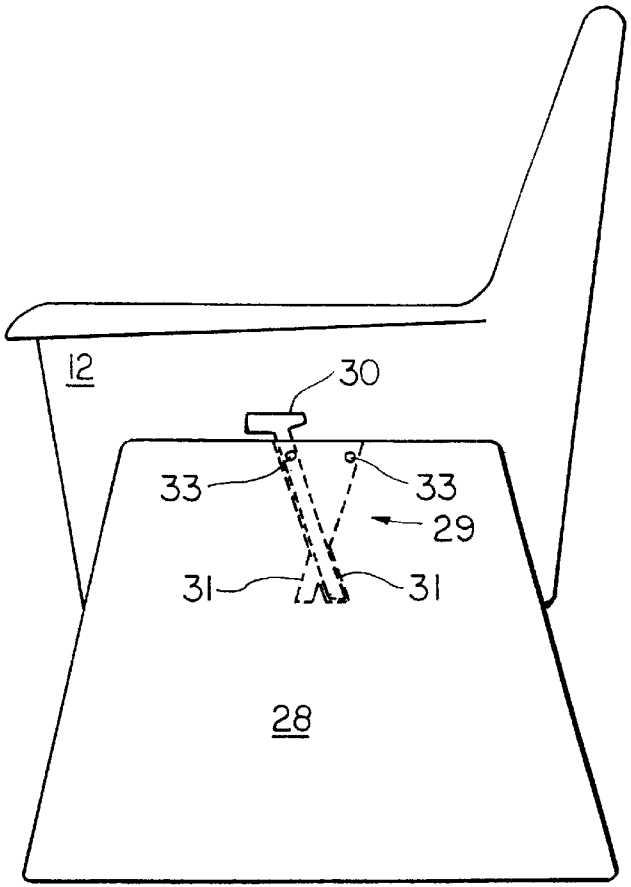
FIG. 1*b* is a side view of an oscillating seat showing a tilt/latching mechanism.

As shown in FIGS. 1*b*, 1*c*, and 1*d*, in accordance with one embodiment of the present invention, the orientation of chair 12 with respect to a chair support 28 may be varied and latched through a tilt/latching mechanism 29. This tilt/latching mechanism 29 includes raised members 30 projecting from both sides of chair 12 (only one member 30 shown). When members 30 are slid into one of mating recesses 31 in the sides of chair support 28, a pin 32 at the top of each member 30 engages a hole 33 at the top of the selected recess 31, locking chair 12 to support 28. The angle of chair 12 with respect to support 28 is determined by the angle of the selected recesses 31. More recesses 31 may be provided in chair support 28 to allow for more precise control over chair angle, and, additionally, constituent parts of the support assembly may be advantageously detached for certain applications.

Figure 7A:
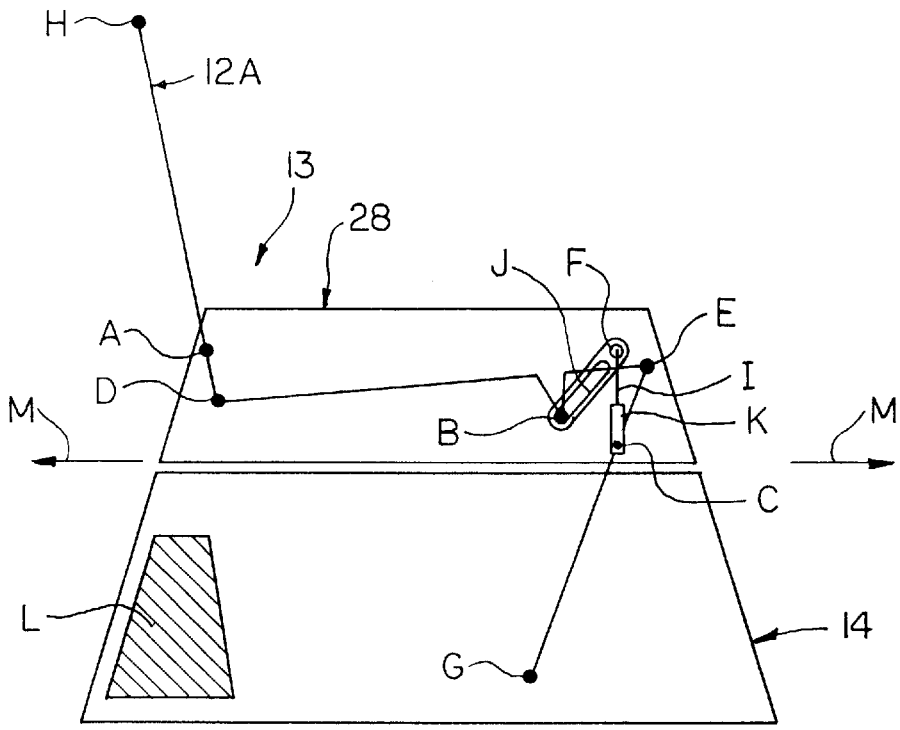
FIGS. 7*a* and 7*b* are side schematic views of an alternate reclining seat assembly.

More particularly, one of the configurations that may be assumed by the support assembly is that of a recliner, as now described with reference to FIGS. 7*a* and 7*b*. An alternate reclining seat assembly is generally indicated by numeral 13. The reference numerals for the base 14 and chair support 28 are the same as previously described, with chair support 28 translating fore and aft via a linkage assembly as previously described. A reclining seat portion is designated generally by numeral 12A and comprises a back rest portion defined between points H and D, a seat portion defined between points D and E, and a foot rest portion defined between points E and G. Points D and E comprise pivot connections for rotation of the respective seat portions. The assembly further comprises a sliding piston pivot link I and a cylinder K. The back rest portion HD is pivotally mounted to the chair support 28 at point A such that movement of point H rearwardly forces movement of point D forwardly. Pivot link I has a first end point F pivotally connected to chair support 28. Seat portion DE is connected at point B to a slot J within seat support 28. Pivot connection F is a single point pivot while B can slide within the slot J. Piston I and cylinder K are pivotally connected between point F and another pivot point C on the foot rest portion KG.

In use, the reclining seat assembly 13 is usually positioned in a normal upright position (FIG. 7*a*) wherein the back rest portion HD is generally upright and the foot rest portion EG is folded beneath the front portion of the base 14. In this regard, it is pointed out that the reclining assembly 13 occupies a minimum of space beneath the chair support 28 and thus advantageously does not interfere in any way with the linkage assembly which may be located beneath the chair support 28. In particular, the reclining mechanism described with reference to FIG. 7*a* may be employed in conjunction with various mechanisms known in the art for providing for motion of a support assembly. Such mechanisms include, for example, and without limitation, the rocking mechanism described in U.S. Pat. No. 4,536,029, which is incorporated herein by reference. Correspondingly, various other mechanisms known in the art for providing a reclining seat assembly may be used in conjunction with various linkages described with reference to FIG. 1*a* and otherwise in the present description. Other means of configuring a reclining support to accomplish the stated objective of maintaining a substantially fixed center of gravity are apparent to persons skilled in the mechanical arts and are within the scope of the present invention as claimed in the appended claims. An advantage of the reclining mechanism of FIG. 7*a* is that a cross-brace L can be used in the rear to accommodate movement of the foot rest portion EG in the front of the assembly.

Figure 7B:
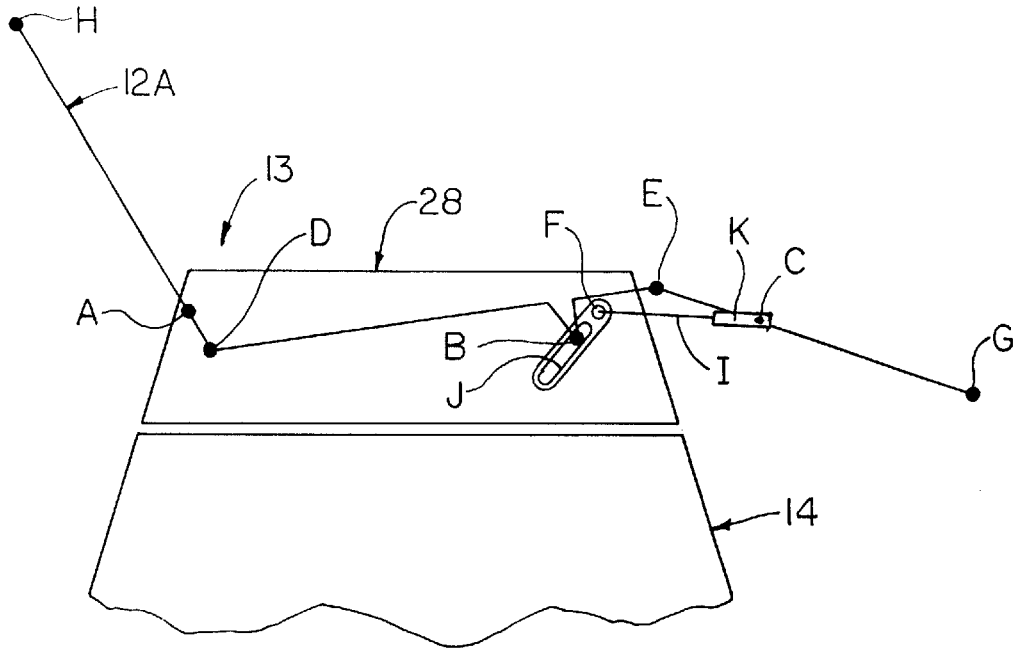

Referring now to FIG. 7*b*, reclining seat 13 is movable from the normal upright position (FIG. 7*a*) to a reclined position simply by pressing backwardly on the back rest portion HD. As stated previously, movement of point H rearwardly forces points D and E, and thus the whole seat portion, in a forward direction. As seat portion DE moves forwardly, point B slides within the slot J to incline the front portion of the seat DE upwardly. Meanwhile, forward and upward movement of point E forces the foot rest portion EG to pivot about point E, while the piston link K extends to force the foot rest portion EG to substantially horizontal position for resting of the feet. Accordingly, it can be seen that chair support 28 can translate fore and aft along lines M relative to the base 14, while the chair 12A can remain upright (FIG. 7*a*), or recline rearwardly (FIG. 7*b*). By translation forward as the seat reclines, the center of gravity of the support assembly, including the weight of the supported person, may be advantageously maintained substantially at the midpoint of the horizontal stroke of the oscillatory motion of the support assembly. Thus, a large range of horizontal travel is preserved that is of substantially symmetrical extent between any limits to motion in the fore and aft directions.

Figure 2A:
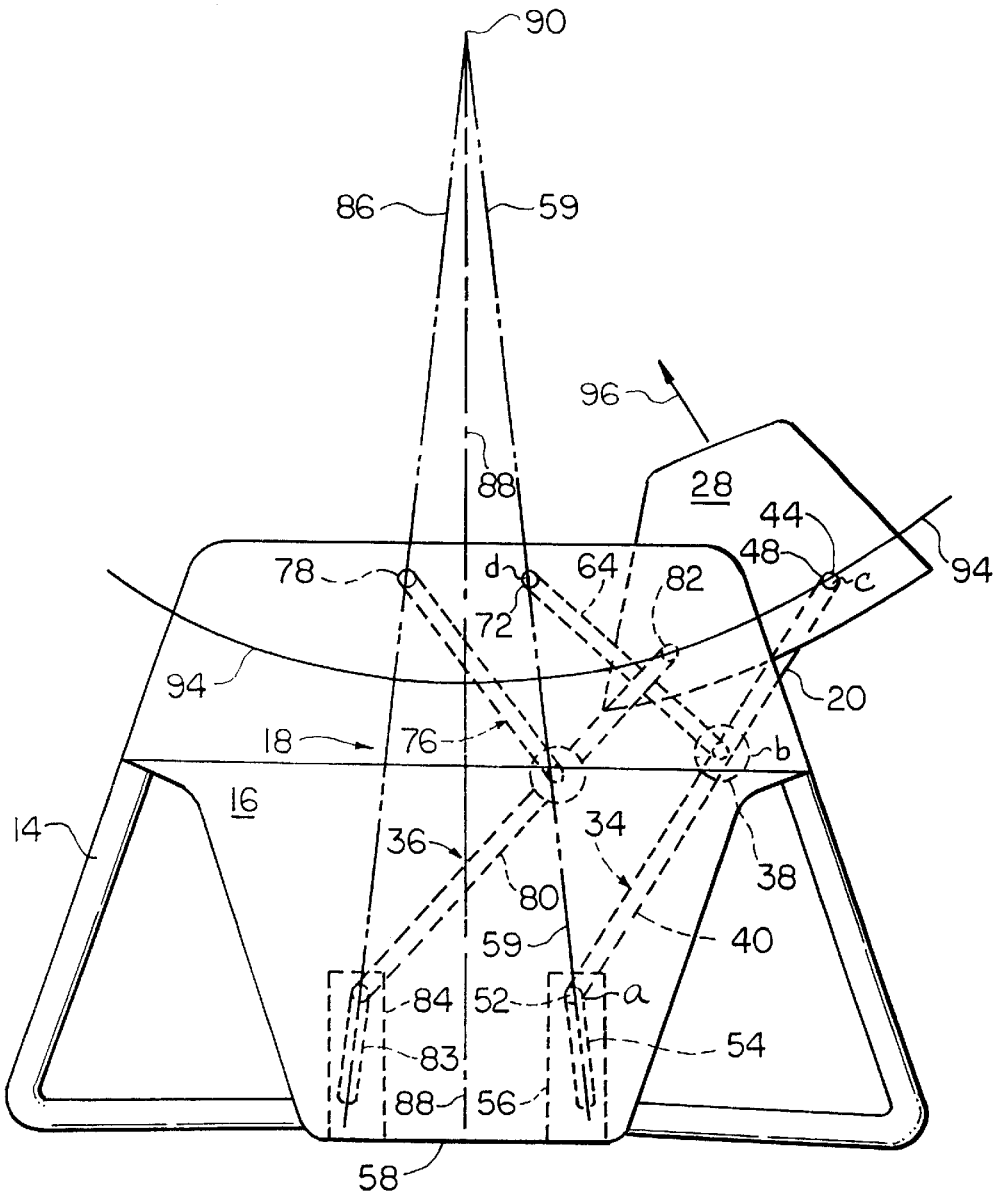
FIGS. 2*a*, 2*b*, and 2*c* are side, front, and schematic side views, respectively, of a linkage assembly of an oscillating seat in accordance with an embodiment of the present invention.
Figure 2E:
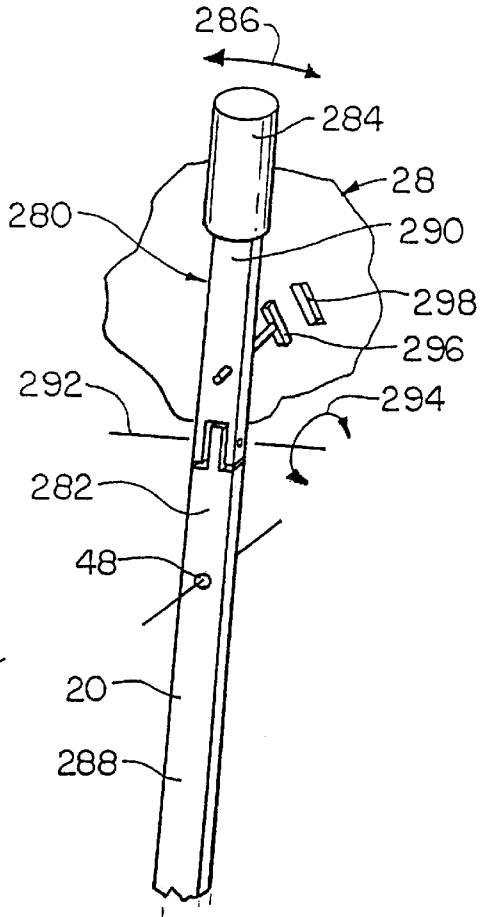
FIG. 2*e* is a fragmentary perspective view showing a braking and locking mechanism preventing movement of the oscillating seat relative to the support structure.
Figure 2C:
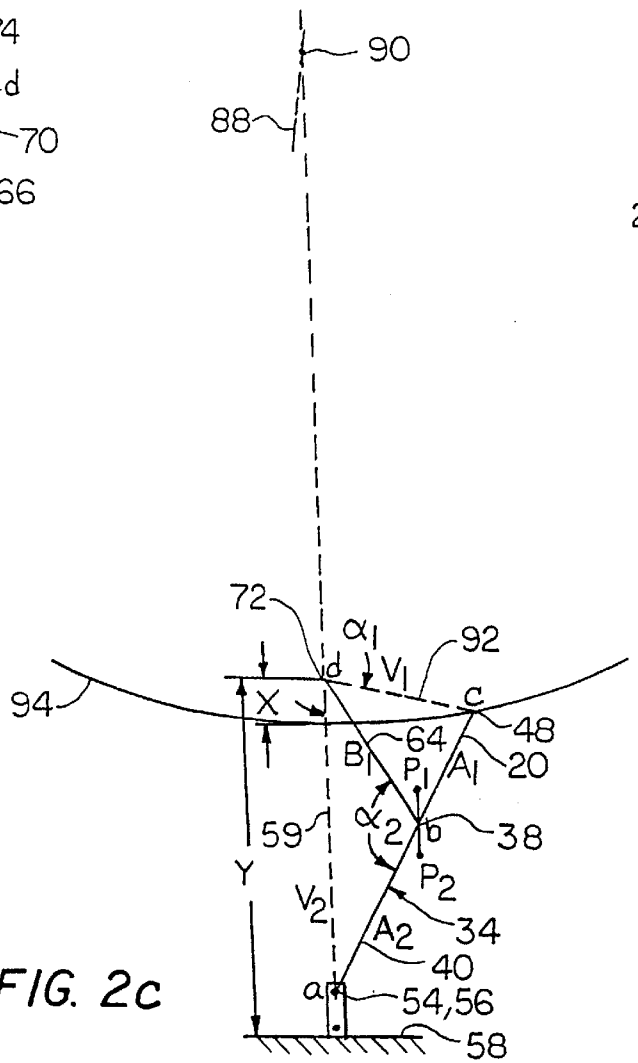
Figure 2B:
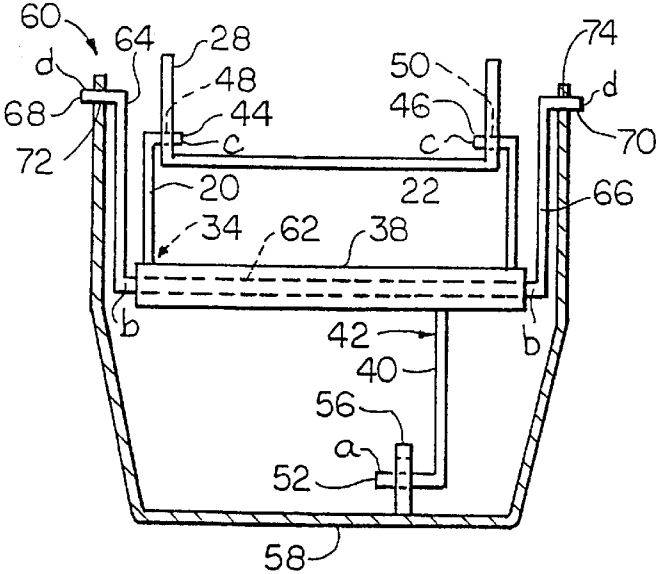

With reference to FIGS. 2*a*, 2*b*, and 2*c*, in accordance with a preferred embodiment of the invention, linkage assembly 18 includes a fore linkage 34 and an aft linkage 36.

In fore linkage 34, links 20 and 22 rigidly attach at the top side of a tubular sleeve 38, and a link 40 rigidly attaches at the bottom side of sleeve 38. Links 20, 22, 40, which may be formed from, e.g., 5/16" (0.79 cm) steel wire or rod, are all generally collinear. Links 20 and 40 together represent a first link of a linkage assembly. Together, sleeve 38 and links 20, 22, 40 form a Y-shaped yoke 42. The free ends 44, 46 of links 20, 22 are bent 90 degrees and inserted into holes 48, 50 in the sides of chair support 28. Holes 48, 50 are sized to allow links 20, 22 to pivot with respect to support 28. The free end 52 of link 40 is likewise bent 90 degrees and inserted into a slot 54 in a slider 56 which serves as a translation mechanism and attached to the floor 58 of housing 16. Slot 54, which extends along an axis 59, is sized to allow link 40 to slide and pivot with respect to slider 56.

Fore linkage 34 also includes a U-shaped yoke 60 having a horizontal cross-member 62 extending through the hollow interior of sleeve 38. Two parallel links 64, 66 project perpendicularly from opposite ends of horizontal cross-member 62. Link 64 represents a second link of the linkage assembly which includes links 20 and 40 (together representing the first link). The free ends 68, 70 of links 64, 66 are bent 90 degrees and inserted into holes 72, 74 in the top of housing 16. Cross-member 62 and links 64, 66 may be formed from, e.g., a unitary section of 1/4" (0.63 cm) steel wire or rod. The hollow interior of sleeve 38 is sized to allow U-shaped yoke 60 to pivot with respect to sleeve 38. Holes 72, 74 are sized to allow links 64, 66 to pivot with respect to housing 16.

Aft linkage 36 is substantially identical to fore linkage 34. The top of a U-shaped yoke 76 in aft linkage 36 is inserted into holes 78 in the top of housing 16 (only one hole 78 shown), allowing yoke 76 to pivot with respect to housing 16. The top of a Y-shaped yoke 80 (to which U-shaped yoke 76 pivotally attaches) in aft linkage 36 is inserted into holes 82 in the sides of support 28 (only one hole 82 shown), allowing yoke 80 to pivot with respect to support 28. Holes 82 are aft of holes 48, 50. The bottom of Y-shaped yoke 80 is inserted into a slot 83 of a slider 84 attached to the floor 58 of housing 16. Slot 83 extends along an axis 86. Slider 84 allows Y-shaped yoke 80 to pivot and slide with respect to housing 16. Axis 59 of slot 54 and axis 86 of slot 83 are inclined towards one another, intersecting with a vertical axis 88 of linkage assembly 18 (i.e., the vertical axis centered between holes 72, 78) at an approximate center point 90 located well above housing 16. The selection of the inclinations of axes 59, 86 is discussed in further detail below. Because of the construction of linkage assembly 18, the weight of fore and aft linkages 34, 36 is, in most instances, sufficient to cause linkage assembly 18 to return to its center position, i.e., the rotational orientation where fore and aft linkages 34, 36 lie on axes 59, 86, respectively.

Holes 72, 78 in housing 16 also lie along axes 59, 86, respectively. Thus, the arrangement of links, pivots, and sliders of each of the fore and aft linkages 34, 36 can be schematically represented as shown in FIG. 2*c*. $A_1$, and $A_2$ represent the respective lengths of links 20, 40, and $B_1$ represents the length of link 64. $V_1$, the distance along a line 92 extending from hole 72 (point d) to hole 48 (point c), varies with the orientation of the linkage, as does $V_2$, the distance along axis 59 from point d to the end of link 40 in slot 54 (point a). The junction of link 20 and link 40 defines point b.

Point d (holes 72, 74) of fore linkage 34 remains fixed with respect to housing 16 as the orientation of linkage 34 changes. Because of slot 54, the orientation of axis 59 also remains fixed with respect to housing 16.

A method for determining dimensions $A_1$, $A_2$, and $B_1$ of fore linkage 34 is described in the '016 patent. Other methods should also be apparent from the details set forth therein. The dimensions of aft linkage 36 are determined in the same manner.

Generally, the external dimensions of rocker seat 10 are chosen in accordance with portability, ergonomic, manufacturing, marketing, shipping, and other considerations, and linkage assembly 18 is designed to fit within the available space. The location of point d (holes 72, 74) is usually selected to provide the maximum clearance between point d and the floor 58 of housing 16.

The desired path of travel of point c is next chosen. In particular, approximate center 90 (which lies along vertical axis 88) and a radius are selected to define a constant-radius path 94.

The radius of path 94 may range from zero to infinity. Moreover, although center 90 in FIGS. 2*a* and 2*c* lies above path 94, it may instead be located below the desired path. While it may not precisely follow path 94, point c (holes 48,50) lies generally on or near path 94 throughout its range of travel (note that hole 82, which defines point c for aft linkage 36, also lies on or near path 94 throughout its range of travel). Approximate center 90 and point d together determine the orientation of inclined axis 59. To avoid interference between free end 52 of link 40 and the bottom of slot 54 as fore linkage 34 rotates under point d and aligns with axis 59, the sum of $B_1$, and $A_2$, should not exceed $Y_1$, the distance along axis 59 between point d and the floor 58 of housing 16. Generally, the sum of $B_1$, and $A_2$ will approximately equal $Y_1$ the available clearance distance.

Once path 94 has been selected, X, the distance between point d and path 94 along axis 59, is then determined. For convention, X is positive if d lies above path 94, and negative if d lies below path 94. The maximum desired forward "stroke" (i.e., the maximum forward limit of travel of point c along path 94), is then chosen. With point c at it maximum stroke position, point a is at the top of slot 54.

With point c at its maximum stroke position (as shown in FIG. 2*c*), to graphically determine the location of point b, an arc of radius $r_1$, is swept from point c, and an arc of radius $r_1$, plus X is swept from point d. The intersection of these two arcs defines point $P_1$. Next, an arc of radius $r_2$ is swept from point c, and an arc of radius $r_2$ plus X is swept from point d to similarly define point $P_2$. A line drawn through points $P_1$, and $P_2$ intersects fore linkage 34 at point b. By selecting point b in this manner, $B_1$, equals $A_1$, Plus X. Thus, when fore linkage 34 lies along inclined axis 59, point c lies on path 94. Note that because of the construction of fore linkage 34, the distance between point a and point c will generally be greater than the distance between point b and point d.

Because of the construction of fore linkage 34, it is possible to describe the location of point c as a function of $V_1$, and the angle $\alpha_1$, between line 92 and axis 59. From the law of cosines. it can be shown that:

$$(A_1+A_2)^2=V_1^2+V_2^2-2V_1V_2\cos(\alpha_1) \quad (1)$$

And because $\alpha_2$, the angle between link 40 and link 64, and $\alpha_3$, the angle between link 20 and link 64, are supplementary angles (and thus $\cos(\alpha_2)=-\cos(\alpha_3)$), it can be shown (also from the law of cosines) that:

$$V_2^2 - \frac{A_2}{A_1}(A_1^2 + B_1^2 - V_1^2) + A_2^2 B_1^2. \quad (2)$$

As discussed above, generally $B_1$ equals $A_1$, plus X, and $B_{1\ plus\ A2}$ equals Y. Thus, using the values of $A_1$, $A_2$, and $B_1$ determined above, equations (1) and (2) can be solved simultaneously to determine $V_1$ as a function of $\alpha_1$. Further, the lengths of slots 54, 83 may be determined by calculating the difference between $V_2$(max) and $V_2$(min), the maximum and minimum values, respectively, of $V_2$ for each linkage 34, 36 as holes 44, 82 move along their respective arcs.

As noted above, the axes 59, 86 of slots 54, 83 of sliders 56, 84 are inclined towards one another to intersect at approximate center 90. With axes 59, 86 inclined in this manner, support 28, and thus also chair 12, pivot as point c for each linkage 34, 36 (holes 48, 50, 82) travels on or near arc 94. In particular, a normal vector 96 projecting from the top of support 28 remains directed toward or near approximate center 90 as linkage assembly 18 rotates and slides about its various axes, much as if support 28 were a pendulum suspended from center 90. Accordingly, a person seated in chair 12 experiences a sensation similar to that of being swung from an overhead linkage hinged at approximate center 90 (a virtual pivot), without the need for such a cumbersome overhead linkage.

Alternatively, the motion of chair 12 may be modified by varying the relative inclinations of axes 59, 86, so they no longer point at approximate center 90. For instance, keeping holes 72, 78 in the locations shown in FIG. 2*a*, sliders 56, 84 could be moved toward vertical axis 88 until they lie directly under holes 72, 78, respectively. In this configuration, axes 59, 86 of slots 54, 83 would be parallel, and holes 44, 82 (and thus also support 28 and chair 12) would remain generally horizontal as support 28 moves through its range of travel.

If space constraints, packaging or aesthetic concerns, structural support issues, or other considerations so dictate, linkage assembly 18 may be inverted, so that point d is located below point a (i.e., point d is at a point of lower gravitational potential energy than point a).

Moreover, pivot joints may be preferable to sliders in some applications. If so, sliders 56, 84 may be replaced with a link, pivoted at one end with respect to housing 16 and at the other end with respect to free end 52 of link 40, that is long enough to provide substantially straight motion at free end 52. Thus, each of these alternatives, the slider and the long link arrangement, comprises a translation mechanism or a translation means that allows free end 52 to translate along a substantially straight axis.

Additionally, the period of oscillation may be determined, either in design of the oscillating seat or by the occupant of the seat. One method for modifying the period of oscillation, given as an example and without limitation, is described with reference to FIG. 2*a*. The position of pivot d may be moved laterally with respect to the position of slider a, with positions closer to vertical alignment corresponding to slower oscillation. A period of oscillation may be chosen to provide relaxation to the occupant, in accordance with a specified functional relationship to the resting heart rate of the occupant. In particular, the oscillation of the support assembly, which need not be truly periodic within the scope of the present invention, may advantageously be approximately equal to the resting heart rate of the occupant.

Figure 3B:
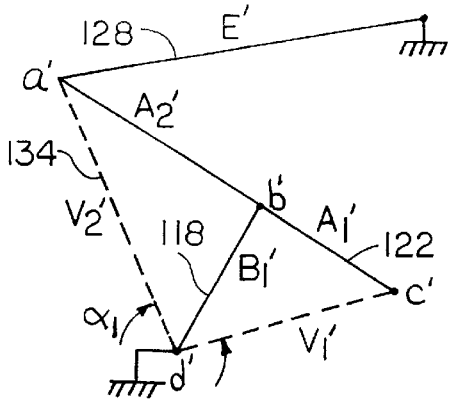
FIGS. 3*a* and 3*b* are side and schematic views, respectively, of another linkage assembly of the oscillating seat.
Figure 3A:
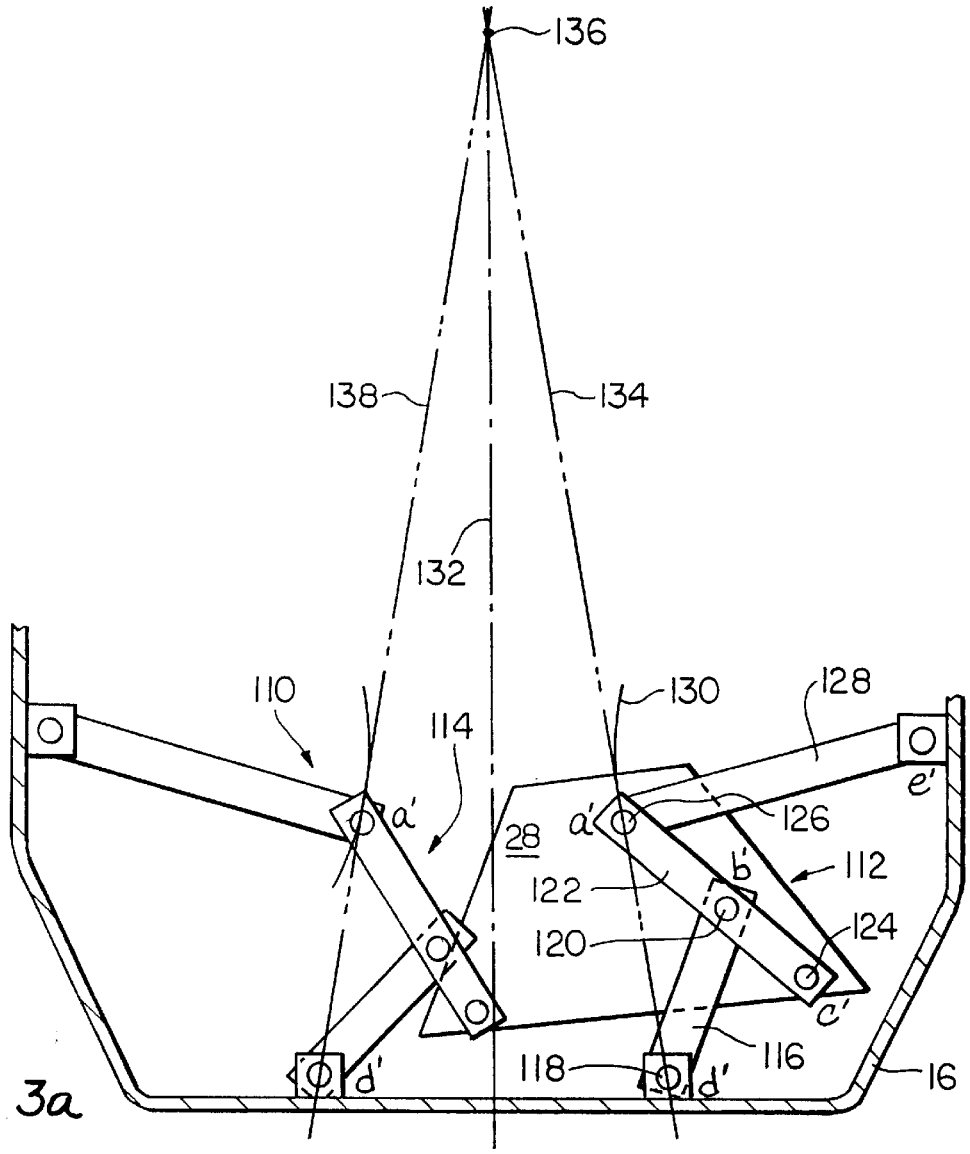

Both of these features are present in the embodiment shown in FIGS. 3*a*, 3*b*, 3*c*, and 3*d*. Linkage assembly 110 includes a fore linkage 112 and a substantially identical aft linkage 114. (Only one side of each linkage 112, 114 is shown in FIG. 3*a*. The side not shown is adjacent to linkage assembly 110, and is essentially a mirror image of the depicted side.) A link 116 in fore linkage 112 pivotally attaches at one end 118 (point d') to housing 16, and at the other end 120 (point b') to the middle region of a link 122. Link 122 pivotally attaches at one end 124 (point c') to chair support 28, and at the other end 126 (point a') to a long link 128 pivotally attached at point e' to housing 16 with this arrangement, long link 128 represents a third link pivotally connected at a first point to a support structure (housing 16) and pivotally connected at a second point to a first point of a first link 122. Thus, point a' moves through an arcuate path 130 determined by the location of point e', and the length of link 128. As explained above, link 128 is sufficiently long that path 130 is substantially straight, and thus approximates the behavior of a slider.

When chair support 28 is centered on vertical axis 132 of linkage assembly 110 (i.e., when chair support 28 is at the midpoint of its travel) (not shown), linkages 116, 122 lie along an inclined axis 134 defined by points a' and d'. Inclined axis 134 intersects vertical axis 132 at an approximate center point 136. In addition, when support 28 is centered in this manner, link 128 lies perpendicular to inclined axis 134, so that path 130 is tangent to inclined axis 134 at the point of perpendicularity. An inclined axis 138 defined by points a' and d' of aft linkage 114 similarly intersects approximate center point 136. The sizes of the various links in the fore and aft linkages 112, 114, as well as the locations of points a', b', c' and d', are selected as described above in connection with FIGS. 2*a*, 2*b*, and 2*c*.

As with linkage 18, support 28 pivots as linkage assembly 110 rotates, much as if support 28 were a pendulum suspended from center 136. Because of the construction of linkage assembly 110, if chair support 28 is unloaded (e.g., if chair 12 is not attached to support 28), the weight of fore and aft linkages 112, 114 may be sufficient to cause linkage assembly 110 to rotate to either its fore or its aft limit of travel. If this is the case, loading chair support 28 will typically cause linkage assembly 110 to return to its center position (i.e., the rotational orientation where fore and aft linkages 112, 114 lie on axes 134, 138, respectively).

Figure 3D:
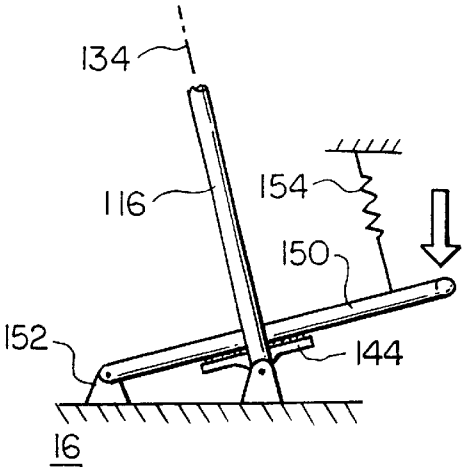
FIGS. 3*c* and 3*d* are schematic perspective and side views, respectively, of a brake mechanism for the oscillating seat of FIGS. 3*a* and 3*b;*
Figure 3C:
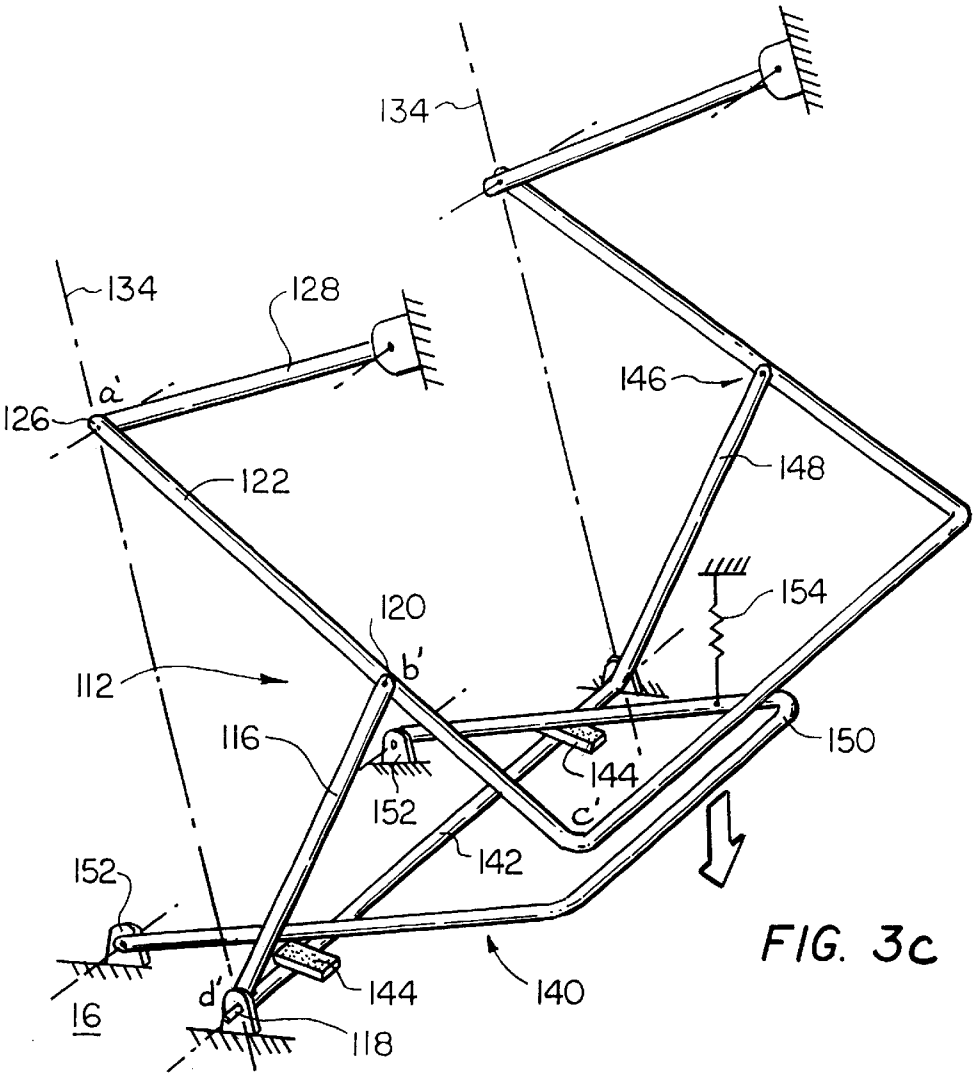

A brake mechanism 140 for stopping the rocking motion of linkage assembly 110 and chair support 28 is shown in FIGS. 3*c* and 3*d*. Brake mechanism 140 includes a horizontal cross bar 142, to which a pair of brake pads 144 are rigidly attached, e.g., by welding. A second fore linkage 146, which is adjacent and substantially identical to fore linkage 112, includes a link 148 oriented parallel to link 116. Links 116, 148 project from opposite ends of horizontal cross bar 142, and are oriented substantially perpendicular to both cross bar 142 and the top surfaces of brake pads 144. Thus, as links 116, 148 rotate about pivots 118, 148, so also do cross bar 142 and brake pads 144.

Brake mechanism 140 further includes a brake bar 150 pivotally attached via hinges 152 to housing 16. A light spring 154 attached to a top region of housing 16 holds the free end of brake bar 150 up. Hinges 152 are located so that when brake bar 150 is forced against spring 154 towards housing 16 (in the direction indicated by the arrows in FIGS. 3*c* and 3*d*), portions of brake bar 150 come into contact with brake pads 144, and force links 116, 148 to align with inclined axis 134. Thus, pressing down on brake bar 150 centers linkage assembly 110, and arrests its rotation.

As shown in FIGS. 4*a*, 4*b*, 4*c*, 4*d*, and 4*e*, another embodiment of a linkage assembly for the rocker seat employs two pair of adjacent, and substantially identical, linkages 210, 211. A link 212 in linkage 210 connects at one end 214 (point a") to a slider 216 attached to housing 16. The other end 218 of link 212 (point c") pivotally attaches to a link 220 extending perpendicularly from the base of chair support 28. Another link 222 pivotally attaches at one end 224 (point d") to housing 16, and at the other end 223 (point f") to a slider 228 at the end 230 of link 220. The axis 232 of slider 216 extends through point d" (pivot 224).

Similar to the embodiment shown in FIGS. 3*a* and 3*b*, linkage assembly 210 could be inverted, and slider 216 could be replaced with a long link arm pivoted at both ends.

The dimensions $A_1$",$A_2$", and $B_1$ linkage assembly 210, as well as the locations of points a", b", c", and d", are selected as described above in connection with FIGS. 2*a*, 2*b*, and 2*c*. Note that in linkage 210, point d" (pivot 224) lies on arc 238. Thus, $B_1$" equals $A_1$,". The length $B_2$" between points b" and f" as well as the length $C_1$" between points c" and f", are chosen so that the axis 234 of slider 228 intersects the axis 232 of slider 216 at or near the approximate center 236 of the arc 238 through which point c" (pivot 218) sweeps. Thus, link 220 and the portion of link 222 extending between point b" and point f" comprise a load control mechanism, keeping support 28 properly oriented as linkage assembly 210 rotates, much as the fore and aft linkages in linkages assemblies 18, 110 cooperate to keep support 28 oriented. As with linkage assemblies 18, 110, support 28 pivots as linkage 210 rotates, much as if support 28 were a pendulum suspended from center 236.

Figure 4B:
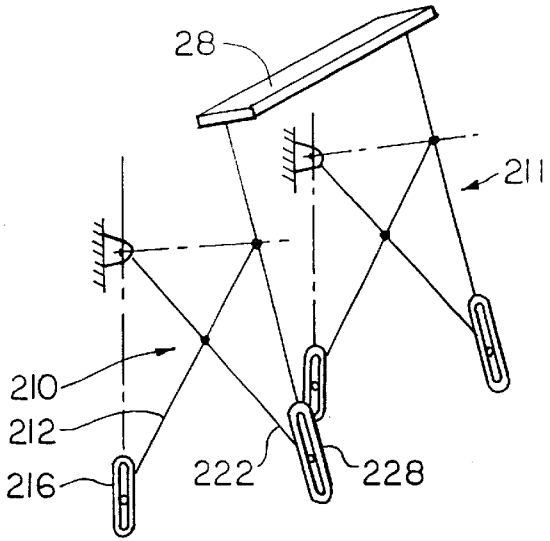
FIGS. 4*a*, 4*b*, and 4*c* are side, schematic perspective, and schematic side views, respectively, of yet another linkage assembly of the oscillating seat.
Figure 4A:
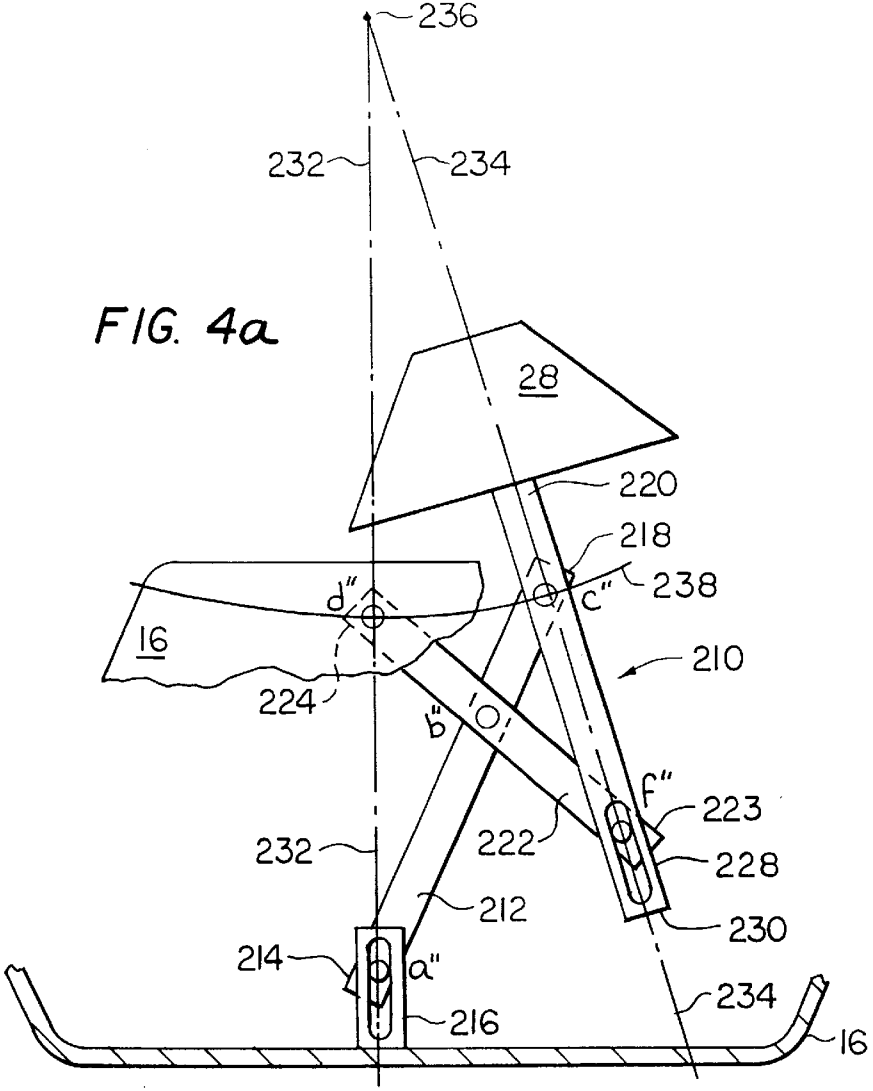
Figure 4C:
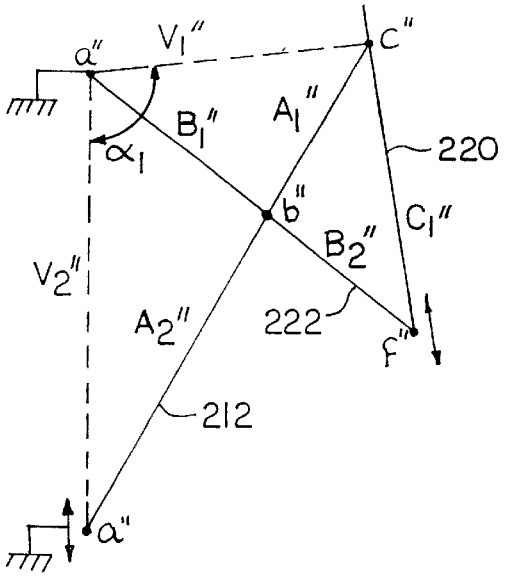
Figure 4D:
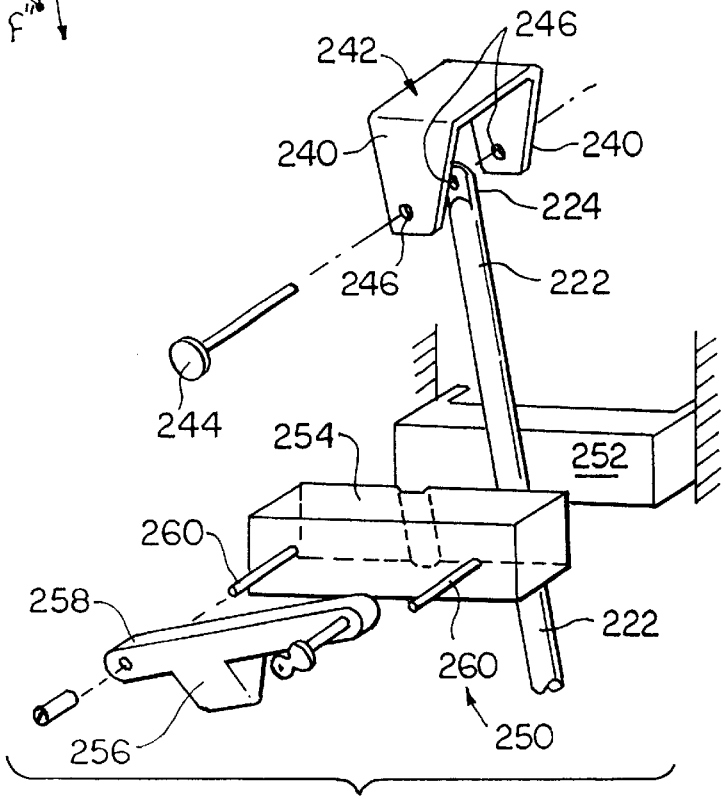
FIGS. 4*d* and 4*e* are exploded perspective and front views, respectively, of a brake mechanism for the oscillating seat of FIGS. 4*a*, 4*b*, and 4*c;*
Figure 4E:
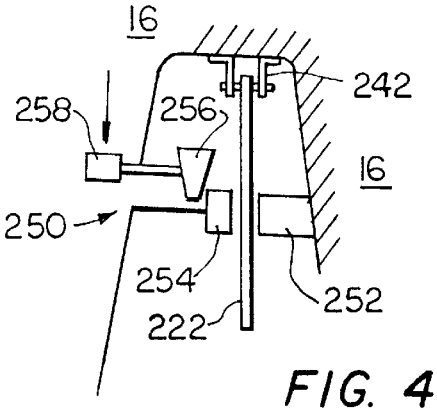

The details of the pivot joint between link 222 and housing 16 are shown in FIGS. 4*d* and 4*e*. The flattened end 224 of link 222 is inserted between the lobes 240 of a U-shaped bracket 242 attached to housing 16. A rivet 244 inserted through holes 246 in the lobes 240 of U-shaped bracket 242 and flattened end 224 allows link 222 to pivot with respect to bracket 242.

A brake mechanism 250 for stopping the rocking motion of linkage assembly 210 and chair support 28 is also shown in FIGS. 4*d* and 4*e*. Brake mechanism 250 includes a fixed brake pad 252, made of a compliant material such as rubber, attached to housing 16. Throughout its range of travel, link 222 remains between fixed brake and 252 and an opposed movable brake pad 254, which is also made of a compliant material such as rubber. A wedge 256 engages the back side of movable brake pad 254. When a handle 258 attached to wedge 256 is rotated downward in the direction indicated by the arrow in FIG. 4*e*, wedge 256 forces movable brake pad 254 along slider pins 260 toward fixed brake pad 252, trapping link 222 in between.

Figure 2D:
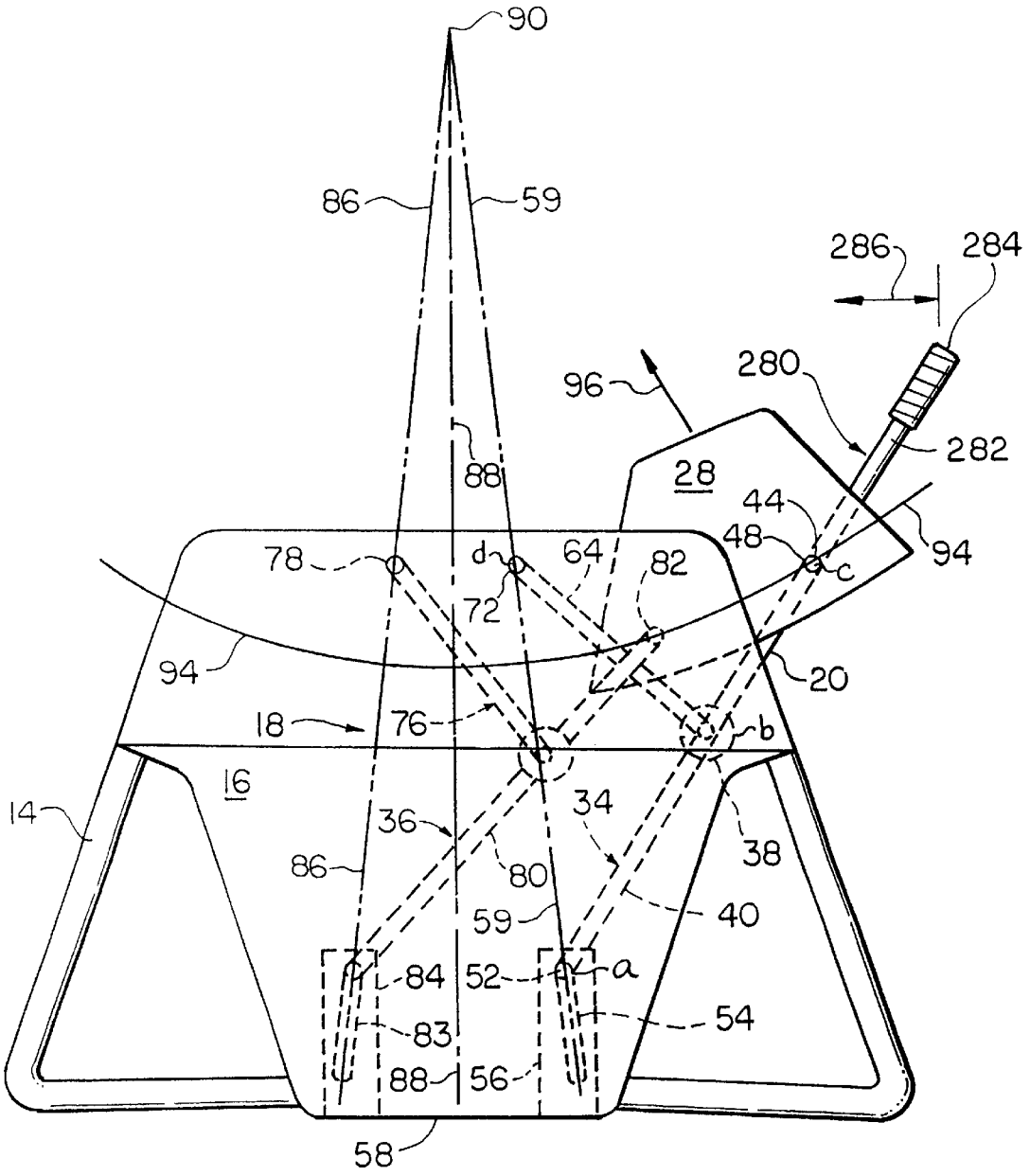
FIG. 2*d* is a side schematic view of the linkage assembly showing a push-handle attached to one of the links that is connected to the chair.

Referring to FIGS. 2*d* and 2*e* there is provided a push handle designated generally by numeral 280 for use by a person seated in the chair 12 to manually create the desired fore and aft movement without significant effort. Referring specifically to FIG. 2*d*, the handle 280 comprises an extension of the link 20 of the pivot linkage 18. The body portion 282 of the handle 280 includes a grip 284 at the terminal end thereof. Movement of the handle 280 fore and aft in the direction of arrow line 286 will cause corresponding fore and aft movement of the chair support 28 and chair 12. With regard to the handle, it is to be understood that the positioning of the handle 280 is not limited to the specific location as described herein. The handle 280 may be connected to any point on the linkage assembly 18 which extends between the base support 14 and the chair support 28 as long as the terminal end of the handle is in a suitable location for grasping by the user seated in the chair. Movement of the handle 280 will thereby causes a relative movement of the chair support 28 relative to the base 14.

Referring now to FIG. 2*e*, a detailed view is shown of the handle of FIG. 2*d*. Seat 10 may be provided with an alternative braking assembly on the handle 280 for preventing oscillating movement of the chair support 28. In this regard, the handle 280 is split into lower and upper portions 288, 290 respectively, which are pivotally connected along a transverse pivot axis 292. The upper handle portion 290 thus pivots inward and outward relative to the lower handle portion 288 along arrow line 294. The braking assembly is defined by interlocking formations formed on the upper handle portion 292, and on either the chair support 28, or the housing frame base 14. In the illustrated embodiment, the interlocking formations comprise a locking T-pin 296 mounted to the upper handle portion 292, and a corresponding slot 298 formed in the body of the chair support 28.

In this regard, inward movement of the upper handle portion 292 rotates the locking pin 296 into the slot 298 to prevent movement of the chair support 28. While a preferred braking assembly is illustrated and described, it is to be understood, that the braking assembly may alternately comprise other types of interlocking formations, and that the braking assembly may be positioned at alternate locations on either the handle or other elements of the apparatus.

In many applications chair 12 may be satisfactorily moved through direct application of force by the person seated therein. It may moreover be desirable to drive the linkage assembly by means of a motor. Drive mechanisms 310, 312 for fore linkage 34 of linkage 18 (FIGS. 2*a*, 2*b*, and 2*c*) are shown in FIGS. 5*a* and 5*b*. Of course, mechanisms 310, 312 could be readily modified for use with other linkages, such as linkages 110 and 210.

Drive mechanism 310 includes an electric or spring motor 314 that drives a pinion gear 316 through a worm gear 318. A link 320 pivotally attaches at one end to pinion gear 316, and at the other end to a short link section 322. Short link section 322 is pivotally attached to housing 16 at or near hole 72 (i.e, the pivot joint between link 64 and housing 16). A spring steel blade 324, laterally constrained at its midpoint by pins 326 projecting from link 64, attaches to the free end of short link section 322.

As pinion gear 316 rotates, link 320 causes short link section 322 to pivot back and forth. Through the compliant connection provided by spring steel blade 324, this imparts a lateral force to pins 326 and link 64, causing fore linkage (and thus also chair 12, not shown) to rotate. The motor speed may be adjusted to drive the linkage at or near its natural frequency.

Drive mechanism 312, shown in FIG. 5*b*, is similar to drive mechanism 310, except that a spring 328 connects at one end to pinion gear 316, and at the other to link 64.

For example, although in the embodiments shown and described above the links are straight, they may be bent or otherwise shaped as necessary. As illustrated in FIGS. 6*a* and 6*b*, a linkage assembly 410 includes a U-shaped yoke 412 pivotally mounted to housing 16 by pivot joints 414, and a Y-shaped yoke 416, one end 417 of which slides in a slider 418 attached to housing 16. A load such as a chair support 28 (not shown) may be coupled, through pivot joints 420, to the top of Y-shaped yoke 416. U-shaped yoke 412 passes through holes 422 in a pair of lobes 424 attached, e.g., by welding, to the upright arms of Y-shaped yoke 416. As shown in FIG. 6*b*, Y-shaped yoke is-bent so that end 417, pivot joints 420, and holes 422 are collinear. Linkage assembly 410 may for example be substituted for either or both of the fore and aft linkages 34, 36 of the embodiment shown in FIGS. 2*a*, 2*b*, and 2*c*.

Figure 8:
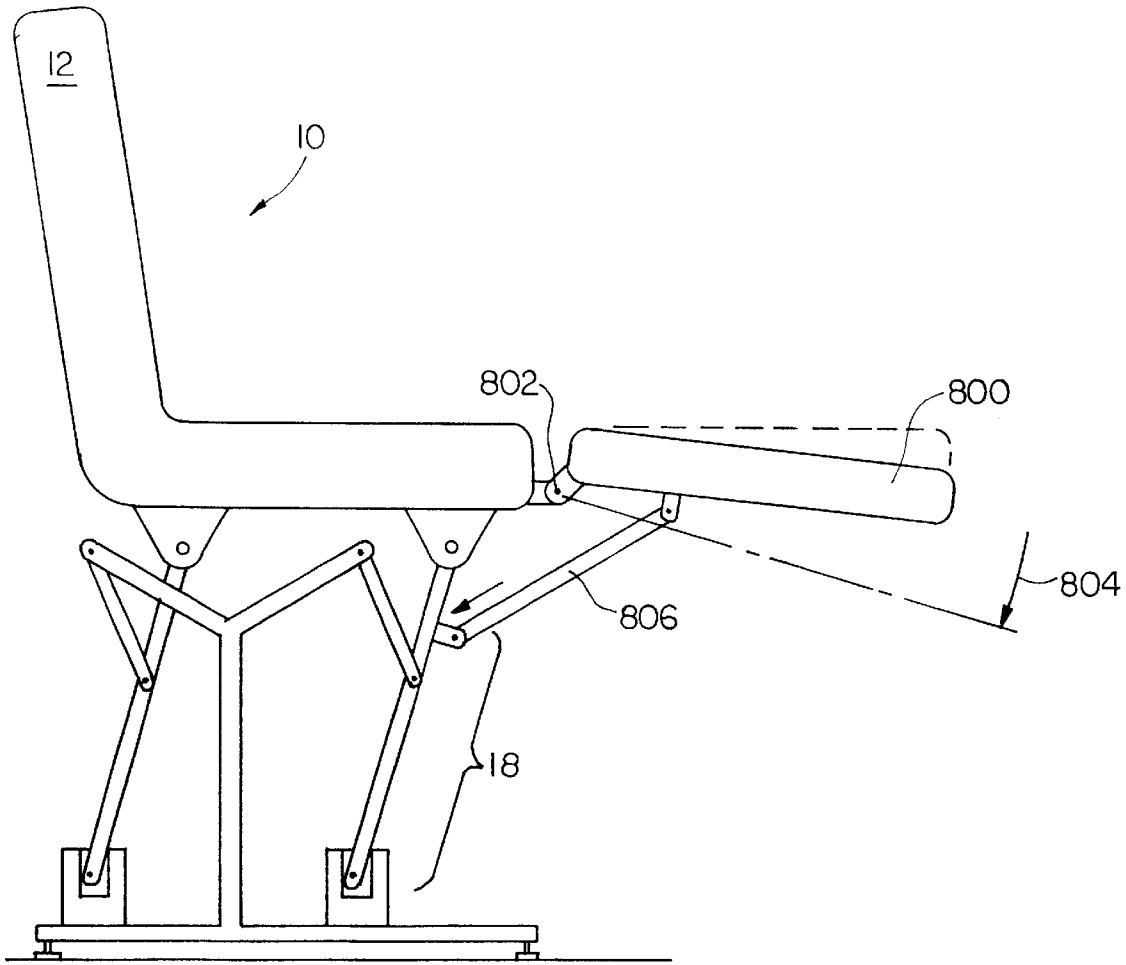
FIG. 8 is a side view of an oscillating seat including a leg- or foot-powered rocking actuator in accordance with an embodiment of the present invention.

FIG. 8 shows a side view of an oscillating seat 10 including a leg- or foot-powered rocking actuator in accordance with certain embodiments of the present invention. Foot pedal 800 is coupled to support assembly 12 at pivot 802 so that it may travel about an angular range designated by numeral 804. Foot pedal 800 may comprise a portion, up to the entirety, of a foot rest for supporting part of the body of the subject seated on support assembly 12. By depressing foot pedal 800, the occupant of the seat actuates linkage mechanism 18 to which foot pedal 800 is coupled via connector 806 which may be a link, as shown, or any other coupling known to persons skilled in the mechanical arts.

A self-centering lock and brake mechanism, in accordance with certain embodiments of the present invention, is now described with reference to FIGS. 9*a* and 9*b*. Operation of the brake mechanism, designated generally by numeral 900, is based on the principal that link 64, coupled to the support assembly at pivot d, is coaligned with link 20 substantially at the center of the horizontal stroke of the support assembly. Thus, the action pinning link 20 in coalignment with link 64 serves to lock support assembly 12 serves to lock the support assembly at a fixed position in its path of motion relative to the fixed segment of the apparatus. In accordance with a specific embodiment of the invention, handle 6 is coupled to sliding housing (or "sleeve") 902 which translates substantially coaxially with, and external to, link 64. The end of sleeve 902 distal to handle 6 has a radially extending pin 904 engaged in Y-shaped slot 906 of yoke 908. Yoke 908 is attached to link 64. Link 64 is locked in relation to link 20 by pushing downward on handle 6, from the position designated by numeral 910 to the position designated by numeral 912. Yoke 908 and pin 904 are advantageously disposed in proximity to pivot point b between links 20 and 64 such that the horizontal travel of pin 904 is small, and the dimensions of slot 906 are correspondingly small. FIG. 9*b* shows brake mechanism 900 is an unbraked position. By pushing down on sleeve 902, pin 904 is urged downward within shaped slop 906, thereby causing links 64 and 20 to be brought into coalignment, and, in the self-same movement, to be brought into the locked position shown in FIG. 9*a*, thus preventing further motion of the support assembly to until the mechanism is unlocked by the occupant.

Figure 9A:
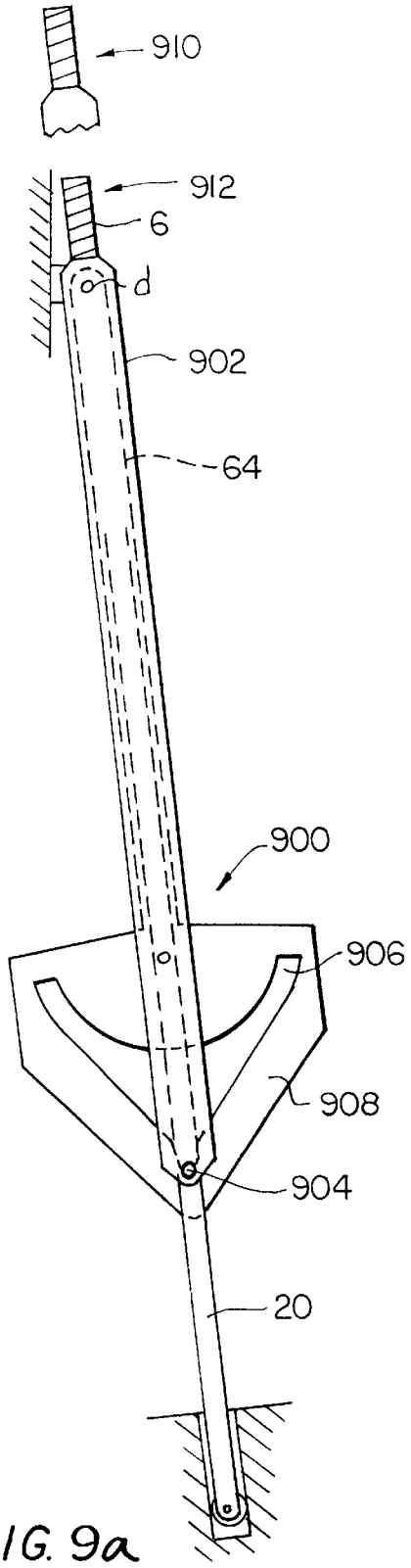
FIG. 9*a* is a side view of a self-centering lock and brake handle in accordance with an embodiment of the present invention, wherein the lock is shown in an engaged position.
Figure 9B:
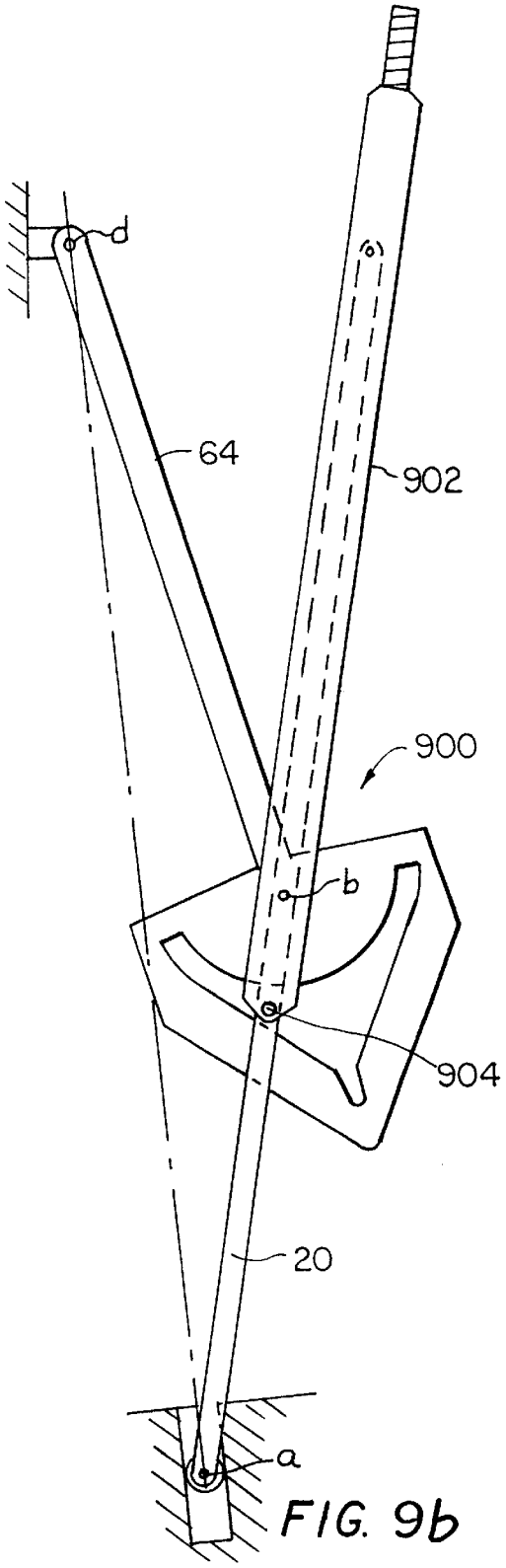
FIG. 9*b* is a side view of the self-centering lock and brake handle of FIG. 9*a*, shown in a "free" position.

Referring once more to FIG. 1*a*, a self-centering lock, brake, and drive mechanism, similar to that described with reference to FIGS. 9*a* and 9*b*, is shown. Here, yoke 9 (corresponding to yoke 908 of FIG. 9*a*) is incorporated into the support assembly, and may be notched, by milling or otherwise, directly into the seat support structure. Yoke 9 is disposed just below the upper point of the pivoted attachment of link 20 to the support assembly. As described with reference to FIGS. 9*a–b*, pushing down on handle 6 causes pin 904 to engage Y-shaped slot 906 (shown in FIG. 9*a*) so as to center and lock the mechanism. However, in the embodiment shown in FIG. 1*a*, the axis of handle 6 is not necessarily aligned or coaxial with either of links 20 or 64.

While the invention has been described in detail, it is to be clearly understood that the same is by way of illustration and example and is not to be taken by way of limitation. Indeed, numerous variations and modifications will be apparent to those skilled in the art. All such variations and modifications are intended to be within the scope of the present invention as defined in the appended claims.

I claim:

1. An apparatus for use on a surface for imparting substantially oscillatory motion to a subject, the apparatus comprising:

a. a support assembly for supporting the subject;

b. an oscillatory mechanism that defines a path of motion of the support assembly, the path having a region bilaterally symmetrical with respect to a reference point and including a horizontal component and a vertical component of travel relative to the reference point, the oscillatory mechanism being substantially supported by a surface-contacting region that is stationary with respect to the surface when the apparatus is in ordinary use; and c. an actuator having a member movable by the subject for permitting the subject while supported by the support assembly to cause a non-gravitational acceleration to be applied to the support assembly.

2. An apparatus for use on a surface for imparting substantially oscillatory motion to a subject having a center of gravity, the apparatus comprising:

a. a support assembly for supporting the subject;

b. an oscillatory mechanism that defines a path of motion of the support assembly, the path having a region bilaterally symmetrical with respect to a reference point and including a horizontal component and a vertical component of travel relative to the reference point, the oscillatory mechanism being substantially supported by a surface-contacting region that is stationary with respect to the surface when the apparatus is in ordinary use; and c. an actuator having a member movable by the subject for permitting the subject while supported by the support assembly to control motion in such a manner that the center of gravity of the subject may remain fixed relative to the support assembly.

3. An apparatus for use on a surface for imparting substantially oscillatory motion to a subject, the apparatus comprising:

a. a support assembly for supporting the subject;

b. an oscillatory mechanism that defines a path of motion of the support assembly, the path of motion having a midpoint, a horizontal component of the path of motion, and a vertical component of the path of motion, the vertical component being substantially symmetric about the midpoint, the oscillatory mechanism being substantially supported by a surface contacting region that is stationary with respect to the surface when the apparatus is in ordinary use and being devoid of a pivot above the subject; and c. an actuator having a member movable by the subject for permitting the subject to control the oscillatory mechanism.

4. An apparatus for use on a surface for imparting substantially oscillatory motion to a subject, the apparatus comprising:

a. a support assembly for supporting the subject;

b. an oscillatory mechanism that defines a path of motion of the support assembly, the path of motion having a pair of endpoints and a position set in from the endpoints where the support assembly comes to rest in the absence of non-gravitational external forces, the oscillatory mechanism being substantially supported by a surface contacting region that is stationary with respect to the surface when the apparatus is in ordinary use and being devoid of a pivot above the subject; and c. an actuator having a member movable by the subject for permitting the subject to control the oscillatory mechanism.

5. An apparatus for use on a surface for imparting substantially oscillatory motion to a subject having an upward reach in normal repose on the apparatus, the apparatus comprising:

a. a support assembly for supporting the subject;

b. an oscillatory mechanism that defines a path of motion of the support assembly, the path including a horizontal component and a vertical component of travel, the oscillatory mechanism being substantially supported by a surface contacting region that is stationary with respect to the surface when the apparatus is in ordinary use and being devoid of a pivot above the reach of the subject in normal repose on the support assembly; and c. an actuator having a member movable by the subject for permitting the subject to control the oscillatory mechanism.

6. An apparatus for use on a surface for imparting substantially oscillatory motion to a subject, the apparatus comprising:

a. a support assembly having an armrest for supporting the subject;

b. an oscillatory mechanism, devoid of an overhead pivot, that defines a path of motion of the support assembly, the oscillatory mechanism being coupled to a surface contacting region that is stationary with respect to the surface when the apparatus is in ordinary use; and c. an actuator having a member movable by the subject for permitting the subject to control the oscillatory mechanism.

7. An apparatus for use on a surface for imparting substantially oscillatory motion to a subject having weight, the apparatus comprising:

a. a support assembly for supporting the subject, the body support assembly comprising:

i. a support surface for bearing the weight of the subject; and ii. an armrest having an uppermost surface;

b. an oscillatory mechanism that defines oscillatory motion of the body support assembly with respect to a member of the apparatus that is fixed with respect to the surface, the oscillatory mechanism having at least one pivot, any said pivot being disposed substantially below the uppermost surface of the armrest; and c. an actuator having a member movable by the subject for permitting the subject to control the oscillatory mechanism.

8. An apparatus in accordance with one of claims 6 and 7, wherein the oscillatory mechanism is substantially contained within a volume beneath the armrest.

9. An apparatus in accordance with one of claims 1 to 5, further including an armrest.

10. An apparatus according to claim 8, wherein the oscillatory mechanism is substantially contained within a volume beneath the armrest.

11. An apparatus in accordance with one of claims 1 to 7, wherein the member is coupled to the oscillatory mechanism.

12. An apparatus in accordance with one of claims 1 to 7, wherein the member is mechanically coupled to the oscillatory mechanism.

13. An apparatus according to one of claims 1 to 7, wherein the member imparts motion to the support assembly.

14. An apparatus according to one of claims 1 to 7, wherein the member in a first mode of operation imparts motion to the support assembly and in a second mode of operation brakes motion of the support assembly.

15. An apparatus according to one of claims 1 to 7, wherein the member is a handle for actuation by a hand of the subject.

16. An apparatus according to one of claims 1 to 7, wherein the member is a foot pedal for actuation by at least one of a leg and a foot of the subject.

17. An apparatus in accordance with one of claims 1 to 7, wherein the support assembly, the subject, and a portion of the oscillatory mechanism together comprise a carriage assembly having a center of gravity, the center of gravity having a path of motion, the support assembly further including a coupling between at least two articulating segments so as to maintain an equilibrium position of the center of gravity of the carriage assembly substantially at a centerpoint of the path of motion of the center of gravity regardless of the orientation of an articulating segment relative to any other articulating segment of the support assembly.

18. An apparatus according to claim 17 wherein the coupling between the at least two articulating segments is a pivotal coupling.

19. An apparatus in accordance with one of claims 1 to 7, wherein the oscillatory mechanism is a glider mechanism.

20. An apparatus in accordance with one of claims 1 to 7, wherein the support assembly is a chair.

21. An apparatus in accordance with one of claims 1 to 7, wherein the support assembly is a couch.

22. An apparatus in accordance with one of claims 1 to 7, wherein the support assembly is a bed.

23. An apparatus in accordance with one of claims 1 to 7, wherein the support assembly includes a plurality of mutually articulating segments for permitting the subject to sit and to recline thereupon.

24. An apparatus in accordance with one of claims 1 to 7, wherein the oscillatory mechanism is a rocker mechanism.

25. An apparatus in accordance with one of claims 1 to 7, wherein the oscillatory mechanism comprises:

a. a first link connected at a first point to a translation mechanism attached to the support assembly, the translation mechanism arranged to allow the first point of the first link to translate along a substantially straight axis;

b. a second link pivotally connected at a first point to the support assembly and pivotally connected at a second point to the first link;

wherein a second point of the first link travels on an arc of substantially constant finite radius when the first link pivots with respect to the second link.

26. An apparatus in accordance with one of claims 1 to 7, further comprising a brake mechanism for arresting the motion of the support assembly.

27. An apparatus in accordance with one of claims 1 to 7, further comprising a brake mechanism for enabling the subject to arrest the motion of the support assembly.

28. An apparatus in accordance with one of claims 1 to 7, further comprising a centering brake assembly for enabling the subject to arrest the motion of the support assembly from a range of positions along the path of motion of the support assembly.

29. An apparatus in accordance with one of claims 1 to 7, wherein the actuator includes a motor.

30. An apparatus according to claim 29, wherein the actuator further includes a power control for the motor, the power control being accessible to the subject.

31. An apparatus in accordance with one of claims 1 to 7, wherein the oscillatory mechanism has an arrangement for modifying a period of oscillation of the support assembly.

32. An apparatus in accordance with one of claims 1 to 7, wherein the oscillatory mechanism has an arrangement whereby the subject may modify a period of oscillation of the support assembly.

33. An apparatus in accordance with one of claims 1 to 7, wherein the surface contacting region includes a base that supports the oscillatory mechanism.

34. An apparatus comprising:

a. a support;

b. a linkage assembly including:

i. a first link connected at a first point to a translation mechanism attached to the support structure, the translation mechanism arranged to allow the first point of the first link to translate along a substantially straight axis; and ii. a second link pivotally connected at a first point to the support structure and pivotally connected at a second point to the first link;

wherein a second point of the first link travels on an arc of substantially constant finite radius wherein the first link pivots with respect to the second link; and c. an actuator assembly for enabling a subject disposed upon the support to control an oscillating motion of the support.

35. An apparatus according to claim 34, wherein the support assembly includes:

a. a chair support;

b. a back rest portion coupled to the chair support at a pivot;

c. a seat portion pivotally coupled to the back rest portion;

d. a foot rest portion pivotally coupled to the seat portion; and e. a foot rest extension mechanism such that reclining the back rest portion rearward about the pivot urges the foot rest portion from a first position substantially below the seat portion to a second position in substantial extension of the seat portion.

36. An apparatus according to any of claims 1–7, wherein the actuator is moveably mounted to the support assembly and coupled to the mechanism so as to maintain approximately the same position relative to the support assembly regardless of the position of the support assembly along the path.

37. An apparatus according to any of claims 1–7, wherein the oscillatory mechanism defines the path without active control of the mechanism.

38. An apparatus for use on a surface for imparting substantially oscillatory motion to a subject, the apparatus comprising:

a. a support assembly for supporting the subject;

b. an oscillatory mechanism that defines an arcuate path of motion of the support assembly, the path of motion having a midpoint, the oscillatory mechanism being substantially supported by a surface contacting region that is stationary with respect to the surface when the apparatus is in ordinary use and being devoid of a pivot above the subject; and c. a member movable by the subject in such a manner as to permit the subject to control the oscillatory mechanism.

* * * * *